US009014601B2

(12) United States Patent
Sato et al.

(10) Patent No.: US 9,014,601 B2
(45) Date of Patent: Apr. 21, 2015

(54) IMAGE FORMING APPARATUS

(71) Applicant: Canon Kabushiki Kaisha, Tokyo (JP)

(72) Inventors: Kengo Sato, Kashiwa (JP); Motohiro Ogura, Kashiwa (JP); Takashi Ueno, Tokyo (JP); Shozo Aiba, Tsukubamirai (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/018,204

(22) Filed: Sep. 4, 2013

(65) Prior Publication Data

US 2014/0064800 A1 Mar. 6, 2014

(30) Foreign Application Priority Data

Sep. 6, 2012 (JP) ..... 2012-196239

(51) Int. Cl.
*G03G 15/01* (2006.01)
*G03G 15/00* (2006.01)

(52) U.S. Cl.
CPC ..... *G03G 15/0178* (2013.01); *G03G 15/0189* (2013.01); *G03G 15/5058* (2013.01); *G03G 2215/0158* (2013.01)

(58) Field of Classification Search
USPC ..... 399/38, 44, 46, 49, 297–302, 308
See application file for complete search history.

(56) References Cited

U.S. PATENT DOCUMENTS

| | | | | |
|---|---|---|---|---|
| 6,633,737 | B1 * | 10/2003 | Tanaka et al. | 399/66 |
| 7,239,833 | B2 * | 7/2007 | Tomita et al. | 399/299 |
| 7,773,894 | B2 * | 8/2010 | Shirakata | 399/44 |
| 7,817,929 | B2 * | 10/2010 | Booth et al. | 399/44 |
| 8,010,026 | B2 * | 8/2011 | Kobayashi et al. | 399/301 |
| 8,270,857 | B2 | 9/2012 | Saitou et al. | |

FOREIGN PATENT DOCUMENTS

| | | |
|---|---|---|
| JP | 2006-11289 A | 1/2006 |
| JP | 2007-108283 A | 4/2007 |

* cited by examiner

*Primary Examiner* — Hoan Tran
(74) *Attorney, Agent, or Firm* — Canon U.S.A., Inc. IP Division

(57) ABSTRACT

A color image forming apparatus includes a first temperature detection unit configured to detect a temperature of an exposure device, a second temperature detection unit configured to detect a temperature of a photosensitive member, a color registration pattern detection unit configured to detect a color registration pattern formed on a transfer member, an actual-measurement-based color registration adjustment value calculation unit configured to calculate an actual-measurement-based color registration adjustment value from a result of the detection of the color registration pattern detection unit, and a prediction-based color registration adjustment value calculation unit configured to calculate a prediction-based color registration adjustment value from the temperature of the exposure device detected by the first temperature detection unit and the temperature of the photosensitive member detected by the second temperature detection unit.

17 Claims, 22 Drawing Sheets

(a) SUB-SCANNING TOP MISREGISTRATION (b) SUB-SCANNING INCLINATION MISREGISTRATION (c) SUB-SCANNING CURVE MISREGISTRATION (d) MAIN SCANNING TOP MISREGISTRATION (e) MAIN SCANNING ENTIRE MAGNIFICATION MISREGISTRATION (f) MAIN SCANNING ONE-SIDE MAGNIFICATION MISREGISTRATION

SOLID LINE: TEMPERATURE NEAR IMAGE BEARING MEMBER
DOTTED LINE: TEMPERATURE NEAR LASER SCANNER

CHANGE IN SUB-SCANNING TOP POSITION

CHANGE IN SUB-SCANNING INCLINATION

CHANGE IN SUB-SCANNING CURVE

CHANGE IN MAIN SCANNING TOP POSITION

CHANGE IN MAIN SCANNING ENTIRE MAGNIFICATION

CHANGE IN MAIN SCANNING ONE-SIDE MAGNIFICATION

DOTTED LINE: C (CYAN)
ONE-DOT CHAIN LINE: M (MAGENTA)
TWO-DOT CHAIN LINE: Y (YELLOW)
SOLID LINE: K (BLACK)

IMAGE FORMING APPARATUS

BACKGROUND OF THE INVENTION

1. Field of the Invention

The present disclosure relates to a color image forming apparatus that can perform color registration adjustment.

2. Description of the Related Art

There is a tandem image forming apparatus that forms a color image by superimposing toner images formed by image forming units provided for respective colors. In such a tandem image forming apparatus, when the toner images of the respective colors are subjected to multilayer transfer, the image forming positions of the image forming units, including photosensitive members and exposure devices (laser scanners), may shift due to an initial installation state, a change over time, or a temperature change. The shifts in the image forming positions of the image forming units cause the misregistration of the images of the respective colors.

To prevent the formation of an image having the misregistration of the images of the respective colors, various color registration adjustment methods are proposed. A color registration pattern is formed using respective image forming units and read by a sensor, thereby detecting the amount of color misregistration. Then, the timing of forming the image of each color is adjusted based on the amount of color misregistration.

Further, there is proposed a technique of predicting the amount of color misregistration from the amount of temperature change without forming a color registration pattern.

Japanese Patent Application Laid-Open No. 2006-11289 discusses a technique of predicting the amount of color misregistration in a sub-scanning direction using a temperature sensor in the housing of an exposure device, and adjusting the timing of scanning.

Further, Japanese Patent Application Laid-Open No. 2007-108283 and U.S. Pat. No. 8,270,857 discuss a technique of correcting the amount of color misregistration by referring to a prediction table based on a temperature change detected by a temperature sensor in an image forming apparatus. Further, if the absolute value of the amount of temperature change in the image forming apparatus is equal to or greater than a threshold, the image forming apparatus forms and measures a color registration pattern. Then, the amount of color misregistration is calculated based on the measurement result. Then, the prediction table is corrected based on the calculated amount of color misregistration and the amount of temperature change at that time.

Recently, however, an image quality required by the market is increasingly heightened. The methods of predicting the amount of color misregistration based only on the amount of change in temperature of an exposure device (laser scanner) or the amount of change in temperature inside an image forming apparatus as in the conventional arts are not sufficient. It is very difficult to predict the amount of color misregistration with high accuracy using only one temperature sensor. It is not possible to sufficiently deal with the influence of a hysteresis due to a rise or fall in temperature inside the image forming apparatus.

SUMMARY OF THE INVENTION

According to an aspect of the present invention, a color image forming apparatus includes a plurality of photosensitive members configured to form images corresponding to a plurality of colors, an exposure device configured to expose each of the photosensitive members to light, a transfer member onto which the plurality of images formed by the plurality of photosensitive members are transferred, a first temperature detection unit configured to detect a temperature of the exposure device, a second temperature detection unit configured to detect a temperature of each of the photosensitive members, a color registration pattern detection unit configured to detect a color registration pattern formed on the transfer member, a calculation unit configured to calculate a color registration adjustment value, and a color registration adjustment unit configured to perform a color registration adjustment based on the color registration adjustment value, wherein the calculation unit includes a first calculation unit configured to calculate an actual-measurement-based color registration adjustment value from a detection result of the color registration pattern detection unit, and a second calculation unit configured to calculate a prediction-based color registration adjustment value from the temperature of the exposure device detected by the first temperature detection unit and the temperature of the photosensitive member detected by the second temperature detection unit.

Further features of the present invention will become apparent from the following detailed description of exemplary embodiments with reference to the attached drawings.

DESCRIPTION OF THE EMBODIMENTS

Figure 1:
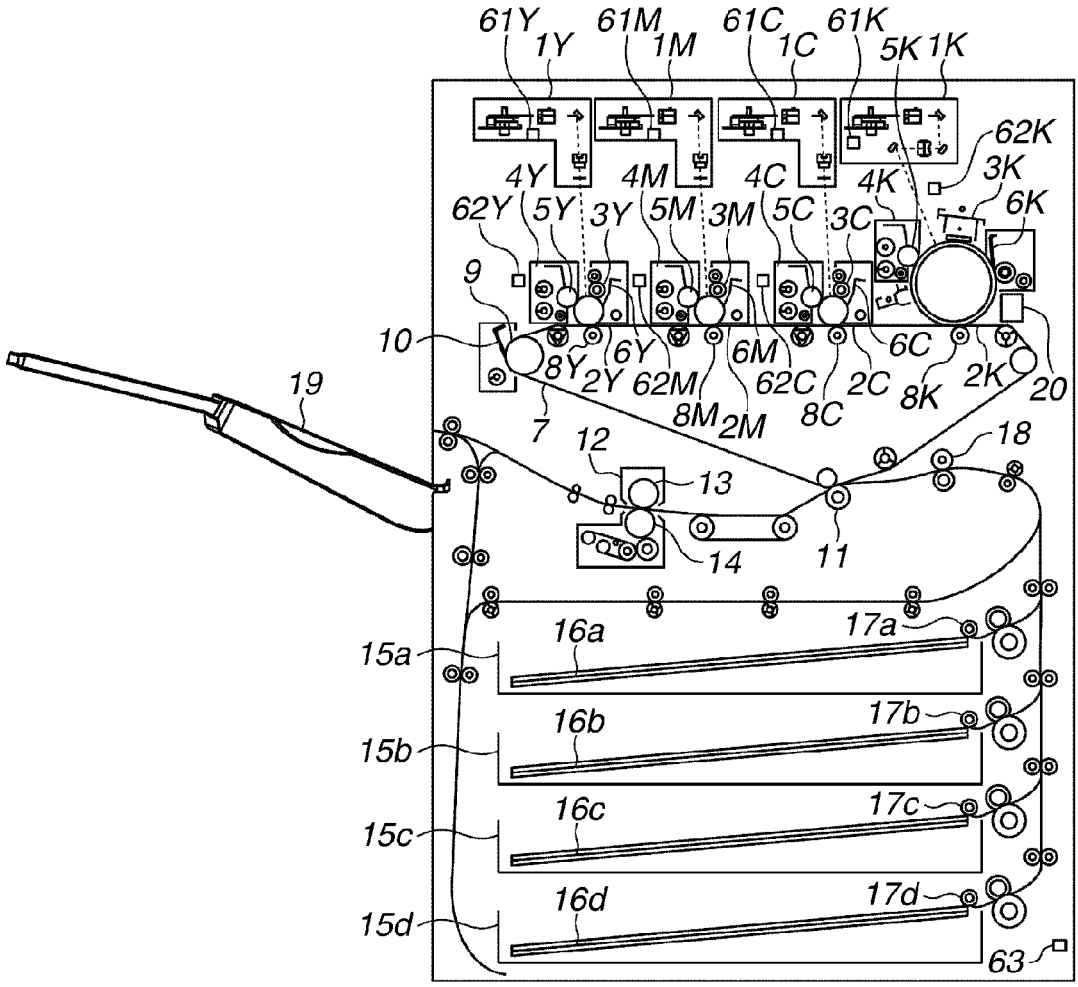
FIG. 1 is a cross-sectional view of an image forming apparatus.

An image forming apparatus according to a first exemplary embodiment is described. FIG. 1 is a schematic cross-sectional view illustrating a configuration of an image forming apparatus. The image forming apparatus has yellow (Y), magenta (M), cyan (C), and black (K) stations and forms color images. The color image forming apparatus includes laser scanner units 1Y, 1M, 1C, and 1K, photosensitive drums 2Y, 2M, 2C, and 2K, charging rollers 3Y, 3M, and 3C, a corona charging device 3K, developing devices 4Y, 4M, 4C, and 4K, developing sleeves 5Y, 5M, 5C, and 5K, and photosensitive drum cleaner units 6Y, 6M, 6C, and 6K. The color image forming apparatus also includes an intermediate transfer belt (transfer member) 7, primary transfer rollers 8Y, 8M, 8C, and 8K, an intermediate transfer belt driving roller 9, an intermediate transfer belt cleaner unit 10, a secondary transfer roller 11, a fixing unit 12, a heating roller 13, and a pressure roller 14. The color image forming apparatus further includes sheet feeding cassettes 15*a*, 15*b*, 15*c*, and 15*d*, recording materials 16*a*, 16*b*, 16*c*, and 16*d*, sheet feeding rollers 17*a*, 17*b*, 17*c*, and 17*d*, a registration roller 18, a sheet discharge unit 19, and a sensor unit 20 having detection sensors.

First temperature detection units 61Y, 61M, 61C, and 61K detect temperatures inside housings of the laser scanner units 1Y, 1M, 1C, and 1K, respectively. Second temperature detection units 62Y, 62M, 62C, and 62K detect temperatures near the photosensitive drums 2Y, 2M, 2C, and 2K, respectively. A third temperature detection unit 63 detects temperature outside the image forming apparatus.

In the color image forming apparatus, the configuration of the K station (the laser scanner unit 1K, the photosensitive drum 2K, and the charging device 3K) is different from the configuration of the Y, M, and C stations. The photosensitive drum 2K has a diameter larger than the diameters of the photosensitive drums 2Y, 2M, and 2C. The charging device 3K is also different from the charging rollers 3Y, 3M, and 3C of the Y, M, and C stations. This configuration enables the life of a K image forming unit to be longer than lives of Y, M, and C image forming units.

The photosensitive drums 2Y, 2M, 2C, and 2K rotate according to the driving force of a driving motor (not illustrated). The driving motor rotates the photosensitive drums 2Y, 2M, 2C, and 2K in a counterclockwise direction according to an image forming operation.

The photosensitive drums 2Y, 2M, and 2C are charged by the charging rollers 3Y, 3M, and 3C, respectively. The photosensitive drum 2K is charged by the corona charging device 3K. The laser scanner units 1Y, 1M, 1C, and 1K expose the charged photosensitive drums 2Y, 2M, 2C, and 2K, to light, respectively, based on image data sent from a controller (not illustrated). Electrostatic latent images are formed on the surfaces of the exposed photosensitive drums 2Y, 2M, 2C, and 2K. The formed electrostatic latent images are developed to produce toner images by the developing devices 4Y, 4M, 4C, and 4K having the developing sleeves 5Y, 5M, 5C, and 5K, respectively.

The intermediate transfer belt 7 is in contact with the photosensitive drums 2Y, 2M, 2C, and 2K and rotates in a clockwise direction. The toner images on the photosensitive drums 2Y, 2M, 2C, and 2K are transferred onto the intermediate transfer belt 7. Then, the toner image on the intermediate transfer belt 7 is transferred onto the recording material 16 sandwiched between the intermediate transfer belt 7 and the secondary transfer roller 11. The secondary transfer roller 11 contacts the intermediate transfer belt 7 during the image formation, and separates from the intermediate transfer belt 7 when the image formation has ended.

The fixing unit 12 fixes the toner image onto the recording material 16. The fixing unit 12 includes the heating roller 13 that heats the recording material 16, and the pressure roller 14 that presses the recording material 16. The heating roller 13 is composed of a member having a low heat capacity such as a film or a belt. The recording material 16 bearing the toner image is conveyed by, and subjected to heat and pressure from, the heating roller 13 and the pressure roller 14, thereby fixing the toner image onto the surface of the recording material 16. Thereafter, the recording material 16 is discharged to the sheet discharge unit 19 by a discharge roller.

The cleaner units 6Y, 6M, 6C, and 6K clean the toner that has not been transferred onto the intermediate transfer belt 7 and remains on the photosensitive drums 2Y, 2M, 2C, and 2K. The cleaner unit 10 cleans the toner that has not been transferred onto the recording material 16 and remains on the intermediate transfer belt 7.

As described above, the image forming apparatus according to the present exemplary embodiment includes a fixing device that can be warmed up on demand. Thus, even if the image forming apparatus has been turned on when the main body of the image forming apparatus is completely cold, the image forming apparatus can start quickly. The image forming apparatus enters a printable (standby) state after several tens of seconds since the image forming apparatus has been turned on.

Figure 2:
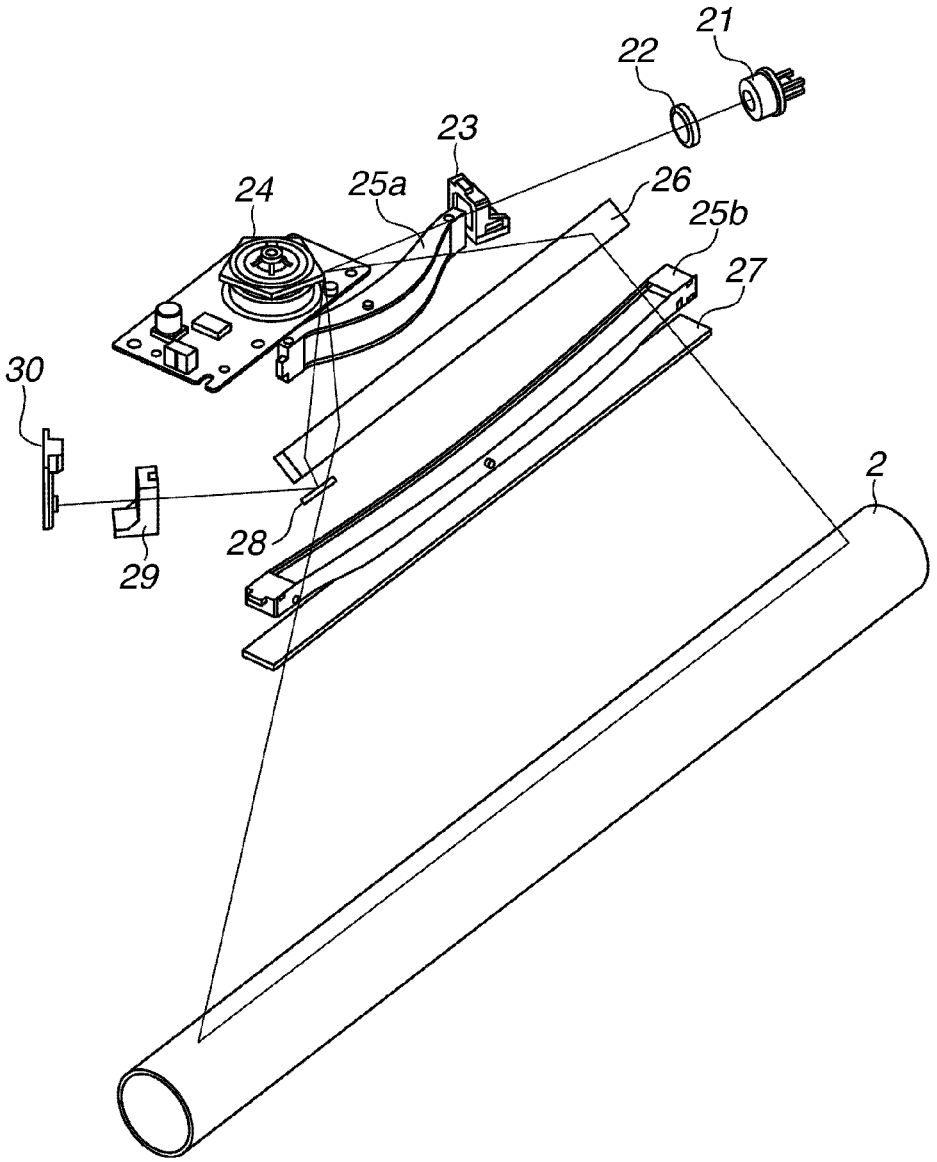
FIG. 2 is a schematic diagram of an optical scanning device.

Next, optical scanning devices (the laser scanner units 1Y, 1M, 1C, and 1K) according to the present exemplary embodiment are described. FIG. 2 is a schematic diagram illustrating an example of a configuration of each of the laser scanner units 1Y, 1M, and 1C.

The configuration of the laser scanner unit 1K is different from the configurations of the laser scanner units 1Y, 1M, and 1C. The configuration of the laser scanner unit 1K, however, is similar to the configurations of the laser scanner units 1Y, 1M, and 1C, except for the number of mirrors and an optical path, and therefore is not described.

In the following descriptions, a main scanning direction represents the longitudinal direction of each of the photosensitive drums 2Y, 2M, 2C, and 2K (the axis direction of the photosensitive drum 2 or the generatrix direction of the photosensitive drum 2), which is the direction in which a scanning optical system of the optical scanning device optically scans the surface of the photosensitive drum 2, or represents a direction corresponding to the longitudinal direction of the photosensitive drum 2. A sub-scanning direction represents the rotational direction of the photosensitive drum 2, or represents a direction corresponding to the rotational direction of the photosensitive drum 2.

Each of the laser scanner units 1Y, 1M, and 1C includes a semiconductor laser 21 that serves as a light source, a collimator lens 22, a cylindrical lens 23, a polygon mirror 24, imaging lenses 25*a* and 25*b*, a reflection mirror 26, a dustproof glass 27, a beam detection (BD) mirror 28, a BD lens 29, and a BD sensor 30. These optical elements (optical members) are accommodated in an optical box (box-like housing) (not illustrated). The optical box also accommodates the first temperature detection unit 61.

An optically modulated light beam emitted from the semiconductor laser 21 is converted into an approximately parallel light beam by the collimator lens 22 and incident on the cylindrical lens 23. An image of the approximately parallel light beam incident on the cylindrical lens 23 is formed almost as a line image on the deflection surfaces of the polygon mirror 24.

The light beam deflected and reflected by the deflection surfaces of the polygon mirror 24 is collected on the surface of the photosensitive drum 2 via the imaging lenses 25*a* and 25*b*, the reflection mirror 26, and the dustproof glass 27, and scans the surface of the photosensitive drum 2 at a constant speed in the main scanning direction by the rotation of the polygon mirror 24.

The BD sensor (synchronization detection device) 30 determines the timing of writing the light beam in the main scanning direction. The BD mirror (synchronization detection mirror) 28 reflects a part of the light beam deflected by the polygon mirror 24, and the BD lens (synchronization detection lens) 29 forms an image of the reflected light beam on the BD sensor (synchronization detection device) 30.

Figure 3:
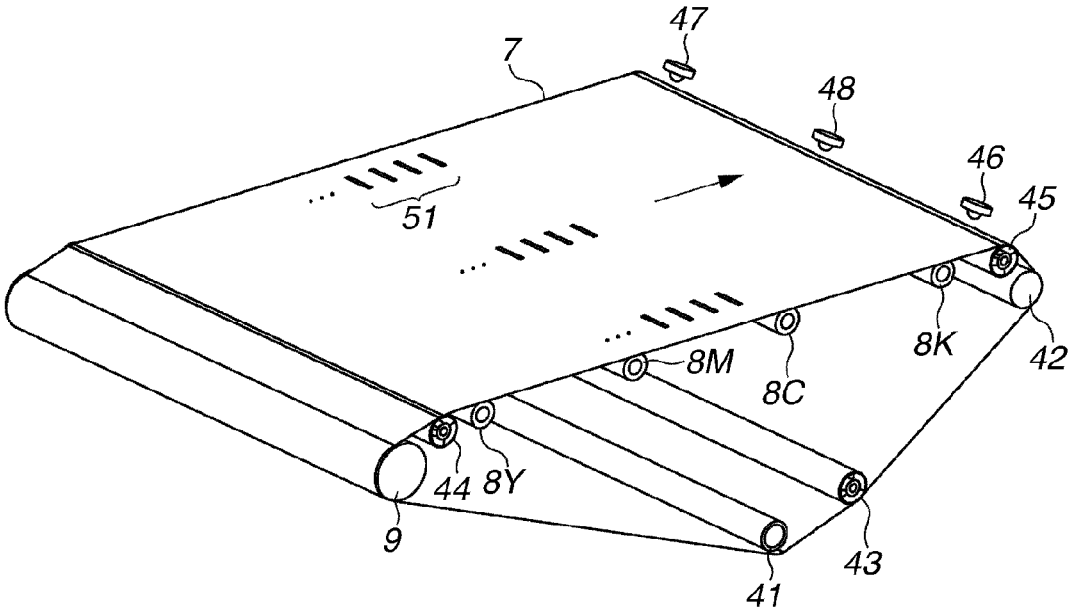
FIG. 3 is a schematic diagram of an intermediate transfer unit.

FIG. 3 is a schematic diagram illustrating an example of a configuration of an intermediate transfer device.

The intermediate transfer device includes the intermediate transfer belt 7, the primary transfer rollers 8Y, 8M, 8C, and 8K, and the intermediate transfer belt driving roller 9. The intermediate transfer device further includes a secondary transfer unit inner surface roller 41, a steering roller 42, idler rollers 43, 44, and 45, a detection sensor (front) 46, a detection sensor (rear) 47, and a detection sensor (middle) 48. A color registration pattern 51 is an example of a color registration pattern for detecting color misregistration.

The secondary transfer unit inner surface roller 41 is an opposing roller that supports the secondary transfer roller 11 when a toner image on the intermediate transfer belt 7 is transferred onto the recording material 16. The idler rollers 43, 44, and 45 are stretching rollers that stretch the intermediate transfer belt 7. The idler roller 43 adjusts the orientation of the intermediate transfer belt 7 so that the recording material 16 can enter the secondary transfer roller portion along the intermediate transfer belt 7. The idler rollers 44 and 45 adjust the orientation of the intermediate transfer belt 7 to maintain primary transfer positions to be approximately linear. The primary transfer positions are formed by the contact portions of the photosensitive drums 2Y, 2M, 2C, and 2K and the primary transfer rollers 8Y, 8M, 8C, and 8K, respectively. Further, the idler roller 45 supports the color registration pattern 51 on the intermediate transfer belt 7, which is detected by the detection sensors 46, 47, and 48.

The detection sensors 46, 47, and 48 detect the color registration pattern 51 formed on the intermediate transfer belt 7.

The steering roller 42 is a roller for correcting the deviation of the belt detected by an intermediate transfer belt deviation sensor (not illustrated). One end (the rear side in the longitudinal direction) of the steering roller 42 is fixed and the other end (the front side) thereof is moved in the up-down direction, thereby correcting the deviation of the intermediate transfer belt 7. The steering roller 42 also has the function of pressing up the intermediate transfer belt 7 by being pressurized in an outward direction of the intermediate transfer belt 7 by a spring (not illustrated).

The intermediate transfer belt driving roller 9, the surface of which is formed of a rubber layer, rotates in the counterclockwise direction by a driving unit (not illustrated) and rotates the intermediate transfer belt 7 (perform conveyance) by the frictional force between the rubber layer and the inner surface of the intermediate transfer belt 7. Further, the intermediate transfer belt driving roller 9 is an opposing roller opposed to the intermediate transfer belt cleaner unit 10 and also has a function of receiving the pressure of a cleaning blade.

FIGS. 4 to 7 are schematic diagrams illustrating examples of color registration patterns formed on the intermediate transfer belt 7.

Figure 4:
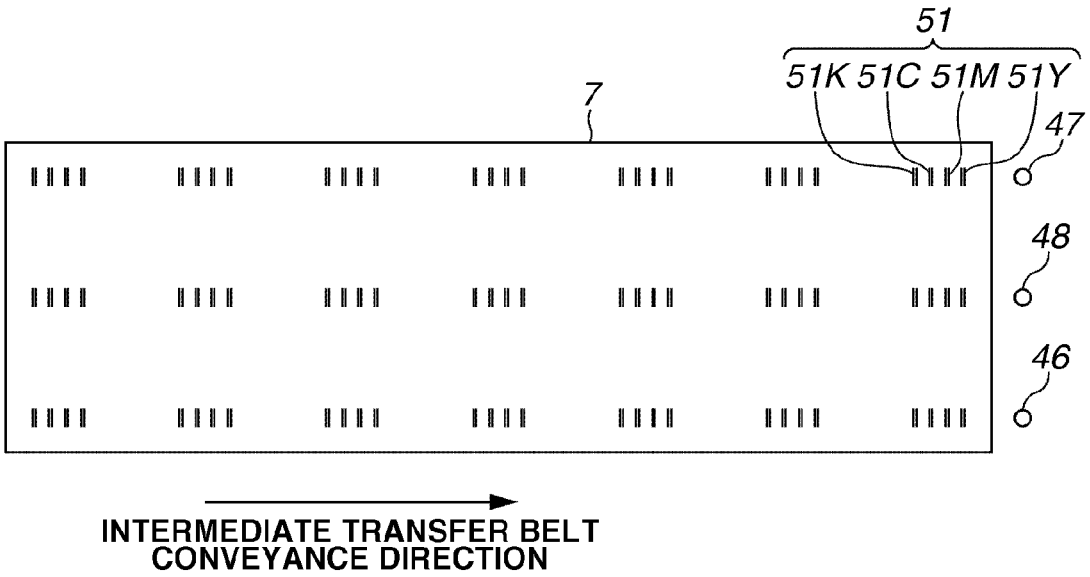
FIG. 4 is an image diagram of a sub-scanning color registration pattern.
Figure 5:
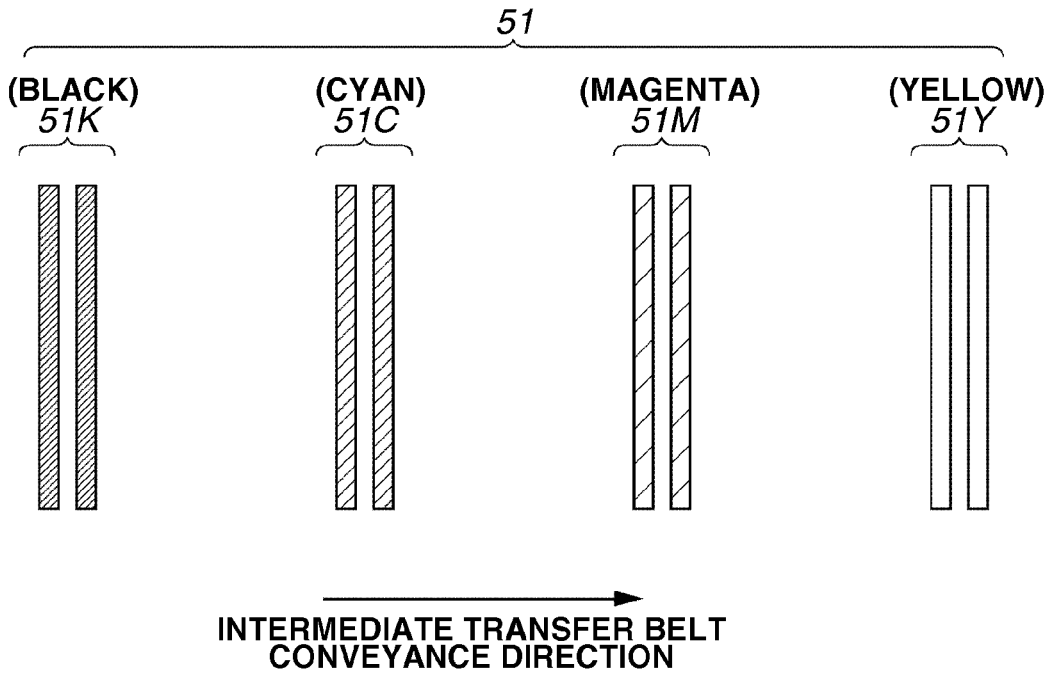
FIG. 5 is an enlarged view of the sub-scanning color registration pattern.

In FIG. 4, color registration patterns 51Y, 51M, 51C, and 51K are patterns for detecting the amount of color misregistration in the sub-scanning direction. FIG. 5 illustrates an enlarged view of the color registration pattern 51 in the sub-scanning direction. Pairs of two patches in the color registration pattern corresponding to each of the colors Y, M, C, and K are formed at regular intervals. The results of detecting the formed pairs of two patches in the color registration pattern corresponding to each color are compared to one another, thereby preventing the erroneous detection of dust and foreign matter.

Figure 6:
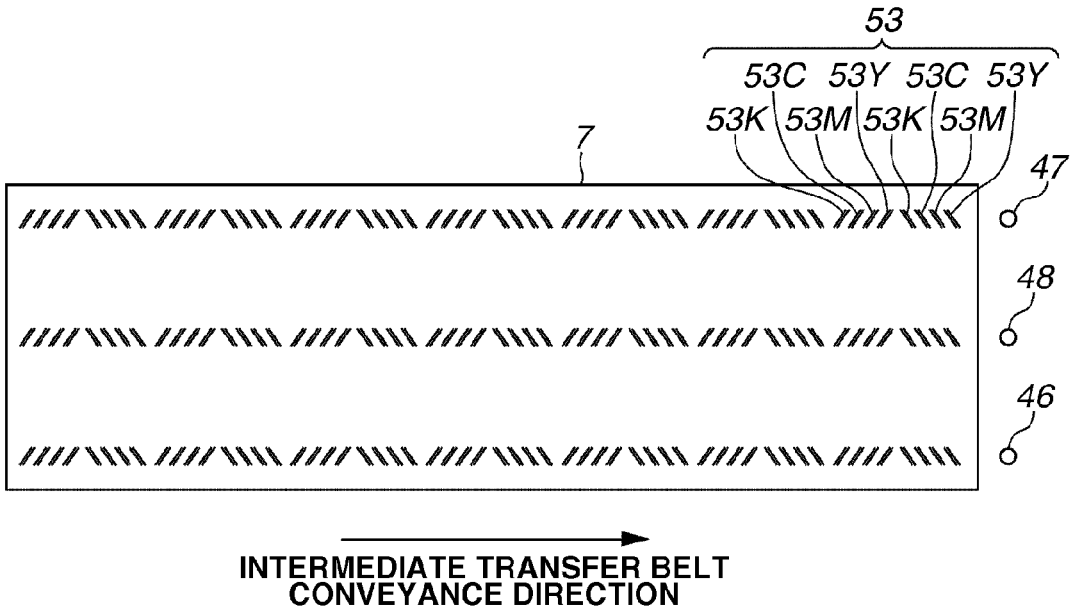
FIG. 6 is an image diagram of a main scanning color registration pattern.
Figure 7:
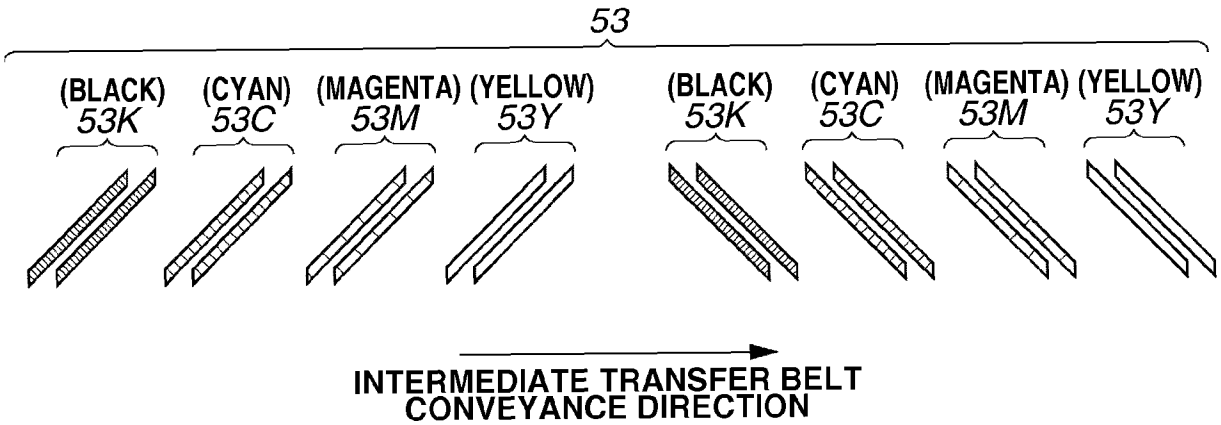
FIG. 7 is an enlarged view of the main scanning color registration pattern.

In FIG. 6, color registration patterns 53Y, 53M, 53C, and 53K are patterns for detecting the amount of color misregistration in the main scanning direction. FIG. 7 illustrates an enlarged view of the color registration pattern 53 in the main scanning direction. Pairs of two patches in the color registration pattern corresponding to each of the colors Y, M, C, and K are formed at regular intervals. Similar to the sub-scanning color registration pattern 51, the results of detecting the formed pairs of two patches in the color registration pattern corresponding to each color are compared to one another, thereby preventing the erroneous detection of dust and foreign matter.

The color registration pattern 53 in the sub-scanning direction and the color registration pattern 51 in the main scanning direction are successively formed, and the amount of color misregistration in the sub-scanning direction and the amount of color misregistration in the main scanning direction are simultaneously calculated. These amounts, however, may be calculated one by one.

The shapes of the figures in the color registration patterns 51 and 53 are not limited to those illustrated in FIGS. 4 to 7 (horizontal lines and oblique lines), and may be shapes such as vertical lines, cross lines, or triangles. Alternatively, the amount of color misregistration in the main scanning direction and the amount of color misregistration in the sub-scanning direction may be detected using only shapes such as oblique lines.

The color registration patterns 51 and 53 illustrated in FIGS. 4 and 6 are detected by the detection sensors 46, 47, and 48. Then, a plurality of types of the amount of color misregistration is calculated based on the results of the detection, and an actual-measurement-based color registration adjustment value is calculated.

Figure 8A:
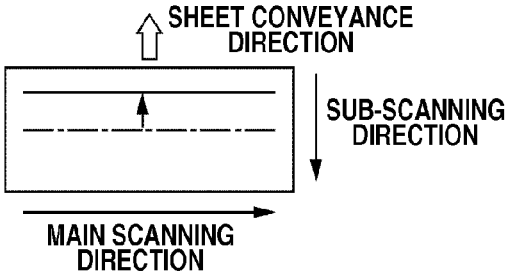
FIGS. 8A to 8F are diagrams illustrating types of color misregistration.
Figure 8B:
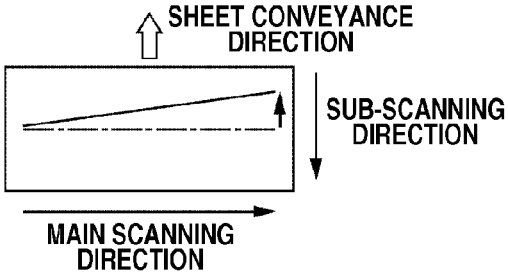
Figure 8C:
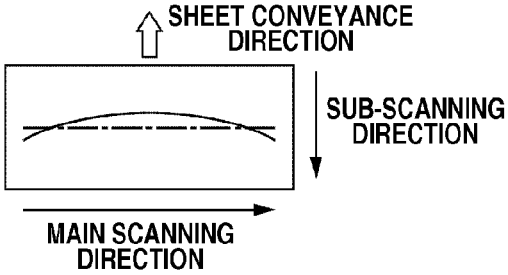
Figure 8D:
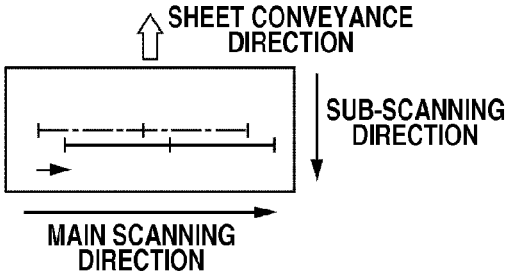
Figure 8E:
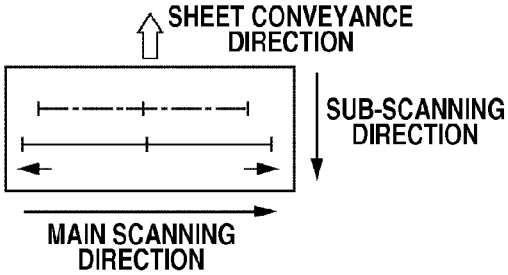
Figure 8F:
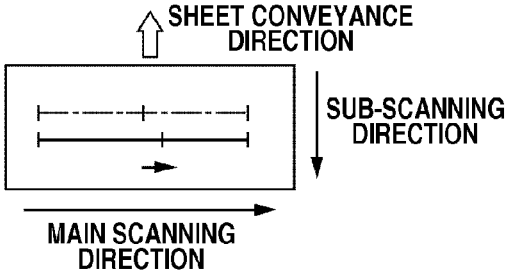

With reference to FIGS. 8A to 8F, the types of color misregistration are described. In FIG. 8A, (a) sub-scanning top misregistration is a phenomenon where the entire scanning line shifts in the sub-scanning direction. In FIG. 8B, (b) sub-scanning inclination misregistration is a phenomenon where the scanning line is inclined in the sub-scanning direction. In FIG. 8C, (c) sub-scanning curve misregistration is a phenomenon where the scanning line is curved in the sub-scanning direction. In FIG. 8D, (d) main scanning top misregistration is a phenomenon where the entire scanning line shifts in the main scanning direction. In FIG. 8E, (e) main scanning entire magnification misregistration is a phenomenon where the length of the scanning line in the main scanning direction changes. In this case, the magnification is the same at any position in the main scanning direction. In FIG. 8F, (f) main scanning one-side magnification misregistration is also a phenomenon where the length of the scanning line in the main scanning direction changes. In (f) main scanning one-side magnification misregistration illustrated in FIG. 8F, the magnification varies depending on the position in the main scanning direction.

In the present exemplary embodiment, to actually measure the amount of color misregistration, these six types of the amount of color misregistration are calculated from the results of detecting the color registration patterns 51 and 53. Then, a color registration adjustment value is calculated according to the six types of the amount of color misregistration.

In the present exemplary embodiment, two different processes are used, that is, an actual-measurement-based color registration adjustment value calculation process for actually measuring the amount of color misregistration using the color registration patterns 51 and 53, and a prediction-based color registration adjustment value calculation process for predicting the amount of color misregistration based on the temperatures measured by the first, second, and third temperature detection units 61, 62, and 63.

Figure 9:
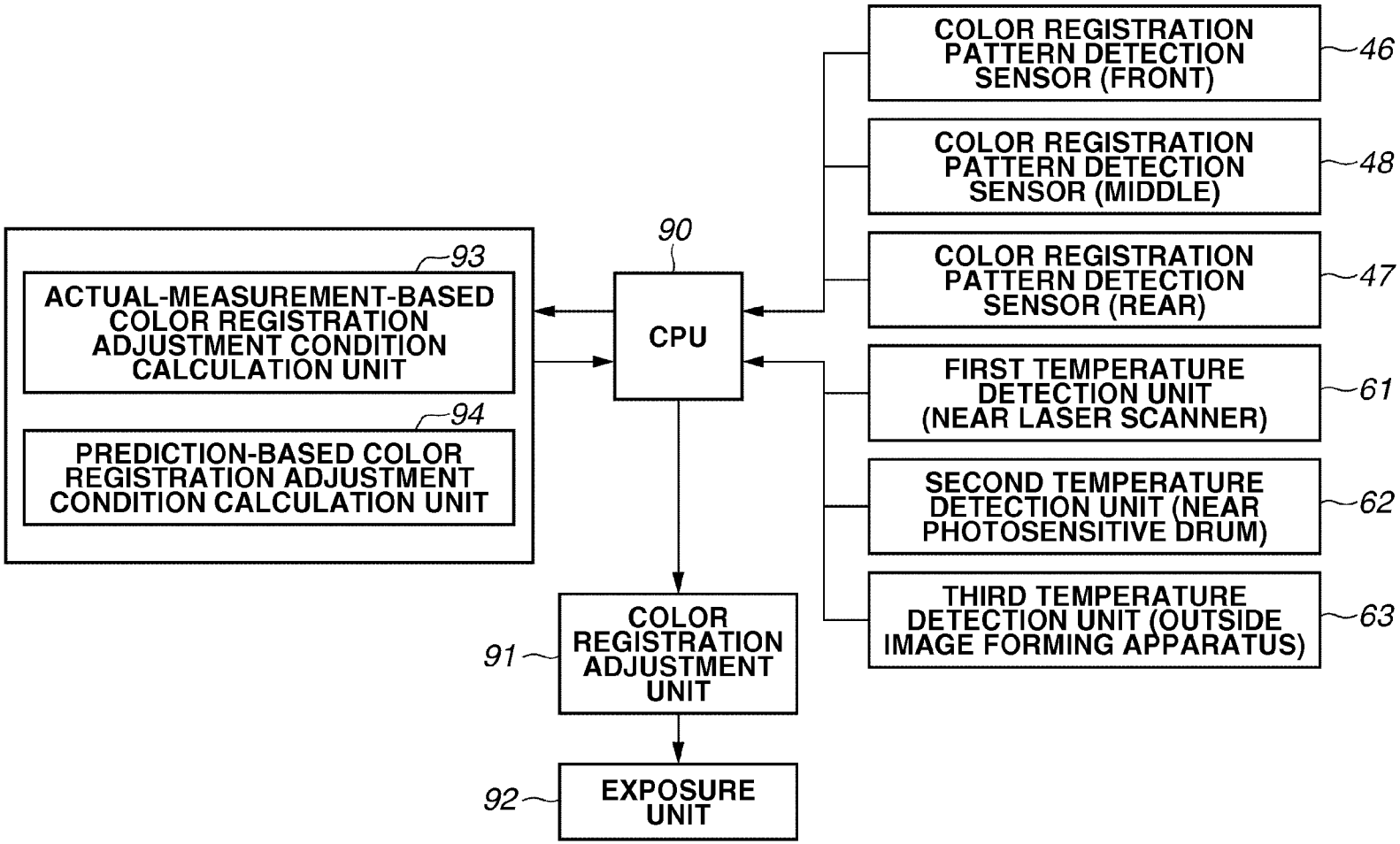
FIG. 9 is a control block diagram regarding a color registration adjustment.

FIG. 9 illustrates a control block diagram regarding a color registration adjustment.

A CPU 90 controls the formation and the measurement of the color registration patterns 51 and 53, and the calculation of color registration adjustment values. The color registration pattern detection sensors 46, 47, and 48 detect the color registration patterns 51 and 53 formed on the intermediate transfer belt 7 and transmit the results of the detection to the CPU 90. The first, second, and third temperature detection units 61, 62, and 63 detect temperatures and transmit the results of the detection to the CPU 90.

An actual-measurement-based color registration adjustment value calculation unit 93 calculates a color registration adjustment value from the detection results of the color registration pattern detection sensors 46, 47, and 48. A prediction-based color registration adjustment value calculation unit 94 predicts a color registration adjustment value from the detection results of the first, second, and third temperature detection units 61, 62, and 63. A color registration adjustment unit 91 performs a color registration adjustment based on the actual-measurement-based color registration adjustment value or the prediction-based color registration adjustment value so that the positions of images to be formed by the stations corresponding to the respective colors coincide with one another. An exposure unit 92 (the laser scanners 1Y, 1M, 1C, and 1K) exposes the photosensitive drums 2Y, 2M, 2C, and 2K to light based on the adjustment result of the color registration adjustment unit 91.

The color registration adjustment unit 91 can use a known color registration adjustment such as: a method of converting pieces of image data of the colors Y, M, C, and K to expand, contract, and distort the pieces of image data; a method of changing the timing of writing, based on the BD sensor 30, in each of the laser scanners 1Y, 1M, 1C, and 1K; and a method of changing the optical path by causing the imaging lenses 25*a* and 25*b* and the reflection mirror 26 to operate by a driving mechanism (not illustrated).

Figure 10:
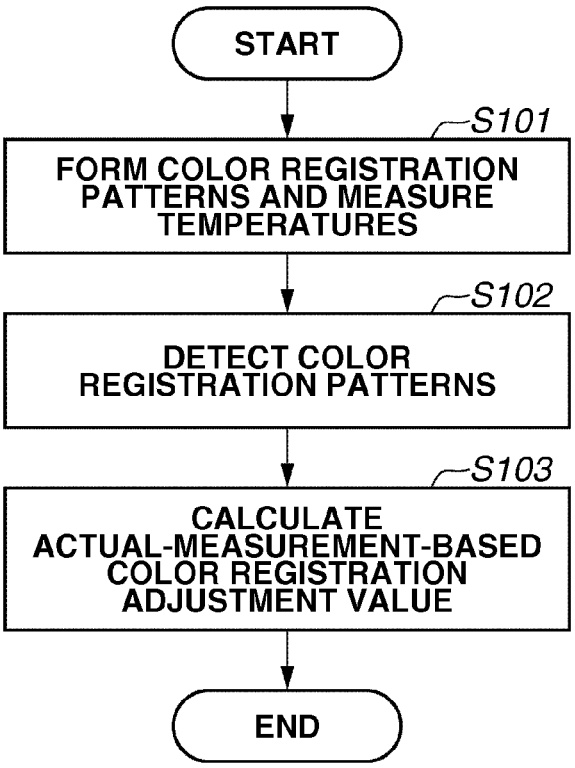
FIG. 10 is a flow chart of processing performed by an actual-measurement-based color registration adjustment value calculation unit 93.

FIG. 10 illustrates a flow chart illustrating processing performed by the actual-measurement-based color registration adjustment value calculation unit 93 (hereinbelow, referred to as unit 93).

First, in step S101, the unit 93 causes the Y, M, C, and K stations to form the color registration patterns 51 and 53 on the intermediate transfer belt 7. Then, the unit 93 obtains temperature detection results from the first, second, and third temperature detection units 61, 62, and 63, and stores the obtained results. The unit 93 stores as temperature data Tls(0) the temperature of the laser scanner unit 1 detected by the first temperature detection unit 61, stores as temperature data Tdrm(0) the temperature near the photosensitive drum 2 detected by the second temperature detection unit 62, and stores as temperature data Tenv(0) the temperature outside the image forming apparatus detected by the third temperature detection unit 63. The pieces of stored temperature data will be used in the prediction-based color registration adjustment value calculation process.

Next, in step S102, the unit 93 obtains the detection results of the color registration patterns 51 and 53 from the color registration pattern detection sensors 46, 47, and 48. In step S103, the unit 93 calculates the above six types of the amount of color misregistration with respect to each color from the results of detecting the color registration patterns 51 and 53, calculates an actual-measurement-based color registration adjustment value from the six types of the amount of color misregistration, and stores the actual-measurement-based color registration adjustment value.

Figure 11:
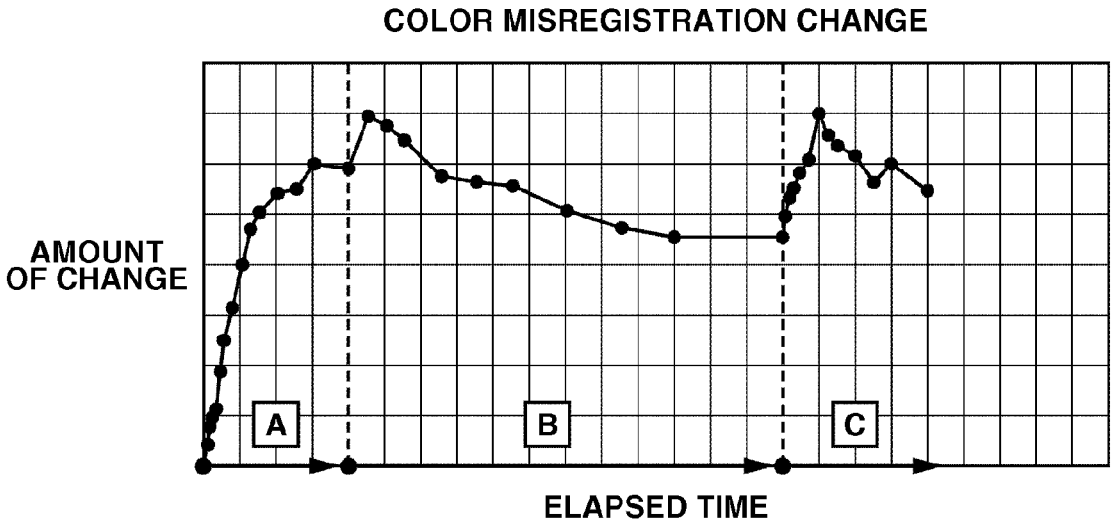
FIG. 11 is a schematic diagram illustrating an example of a change in an amount of color misregistration of the image forming apparatus.

FIG. 11 is a schematic diagram illustrating an example of change in the amount of color misregistration of the image forming apparatus. A section A represents a state of a continuous printing operation. A section B represents a sleep state. A section C represents a state of a continuous printing operation again.

Figure 12:
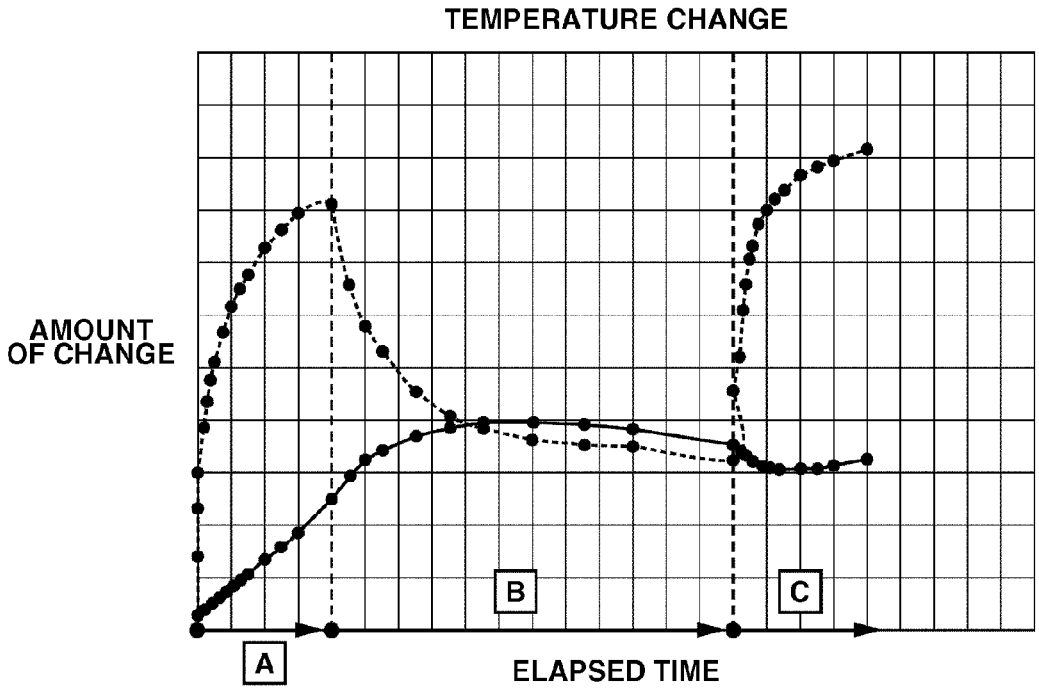
FIG. 12 is a diagram illustrating a relationship between a change in temperature near a laser scanner and a change in temperature near an image bearing member.

FIG. 12 illustrates a relationship, corresponding to FIG. 11, between a change in temperature near a laser scanner and a change in temperature near an image bearing member. The temperature near the laser scanner rises during the continuous printing operations in the sections A and C, and falls in the sleep state in the section B. On the other hand, the temperature near the image bearing member rises even in the sleep state in the section B. This is a result of influence by the stoppage of a fan inside the image forming apparatus when the image forming apparatus has entered the sleep state. As illustrated in FIGS. 11 and 12, the changes in temperature and the change in the amount of color misregistration have steep slopes immediately after a quick start. This tendency is remarkable particularly in the section A.

In an image forming apparatus having an on-demand fixing device, the temperatures around image forming units rapidly rise for several minutes even after the start of the image forming apparatus. Thus, a printing operation is performed while the temperatures of the image forming units are rapidly changing. If a printing operation is performed while the temperatures of the image forming units are rapidly rising, the amount of color misregistration changes due to the changes in temperature.

The image forming apparatus having the on-demand fixing device can start quickly. Therefore, if a printing operation is not performed, the image forming apparatus does not need to wait for the next printing operation with the temperature of the fixing device regulated to a certain temperature or above as in a conventional image forming apparatus. In other words, if a printing operation is not performed even for a short time, the image forming apparatus can be brought into the sleep state, where the application of current to the fixing device and the image forming units is stopped. This enables a significant reduction in standby power consumption. Meanwhile, the image forming apparatus having the on-demand fixing device transitions to the sleep state in a short time, and the temperatures of the image forming units fall. The image forming apparatus may repeat a quick start and the transition to the sleep state in a short time, depending on the conditions of the use of the image forming apparatus. This results in rapid change in temperature of the image forming units. The amount of color misregistration changes due to the rapid change in temperature of the image forming units.

To suppress the amount of color misregistration to a predetermined value or less using the actual-measurement-based color registration adjustment value calculation process, it is necessary to frequently perform the actual-measurement-based color registration adjustment value calculation process. Particularly in the section A, it is necessary to perform the actual-measurement-based color registration adjustment value calculation process as frequently as every several tens of seconds or every several minutes. This significantly reduces the productivity. Further, the frequent formation of color registration patterns increases the toner consumption.

Therefore, in the present exemplary embodiment, the amount of color misregistration is estimated from the temperatures detected by temperature detection units, and a color registration adjustment value is predicted without forming color registration patterns. According to the present exemplary embodiment, it is possible to output a high-quality image in which color misregistration has been suppressed, without reducing the productivity. The prediction-based color registration adjustment value calculation process is described in detail below.

Figure 13:
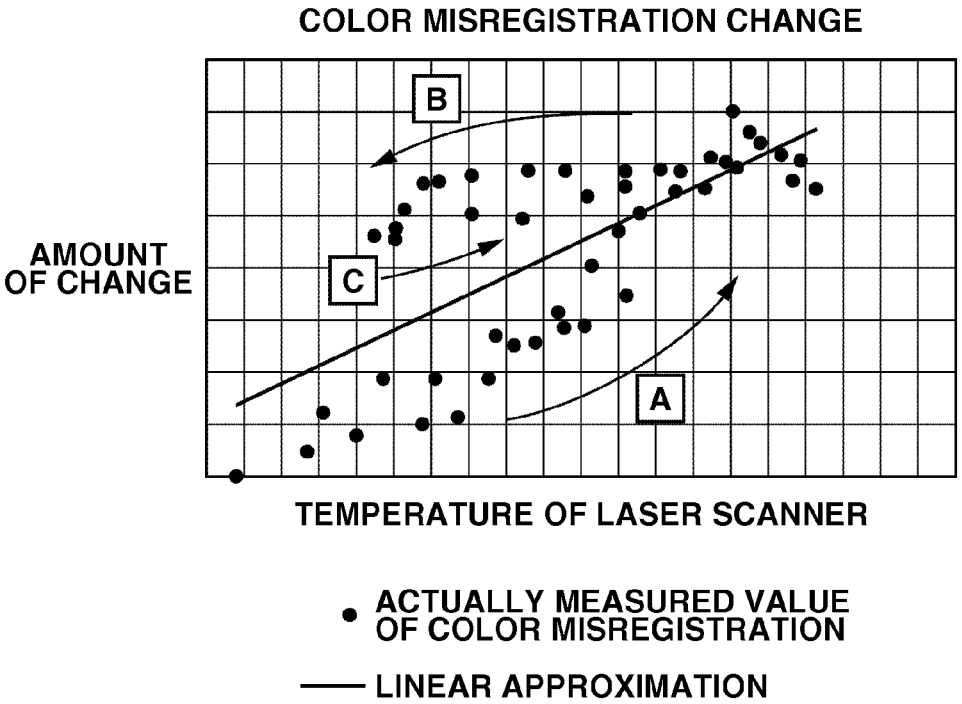
FIG. 13 is a diagram illustrating a relationship between a change in temperature of a laser scanner unit and a change in an amount of color misregistration.

FIG. 13 is a diagram illustrating a relationship, corresponding to FIG. 11, between a change in temperature of the laser scanner unit 1 and a change in the amount of color misregistration. FIG. 13 also illustrates a result of a first-order linear approximation between the change in temperature of the laser scanner unit 1 and the change in the amount of color misregistration. The change in the amount of color misregistration represents the change in the amount of color misregistration from a certain reference time. In FIG. 13, the reference point is where the amount of change is 0, that is, an actually measured value first obtained in the section A. It is understood from FIG. 13 that the first-order linear approximation cannot represent the relationship between the change in temperature of the laser scanner unit 1 and the change in the amount of color misregistration. Further, even a high-order linear approximation cannot represent the relationship either. This is because the change in the amount of color misregistration is influenced by a hysteresis due to a rise in temperature or a fall in temperature, and is influenced by, as well as the change in temperature of the laser scanner unit 1, the changes in temperatures of the photosensitive drum 2 and a primary transfer unit.

Therefore, in the present exemplary embodiment, the amount of color misregistration is predicted from pieces of temperature data of the temperatures detected by a plurality of temperature detection units. More specifically, the amount of color misregistration is calculated using any one of the pieces of temperature data of the temperatures detected by the temperature detection units 61Y, 61M, 61C, and 61K, which detect the temperatures of the laser scanner units 1Y, 1M, 1C, and 1K, respectively, or the average value of the pieces of temperature data (hereinafter collectively referred to as the "temperature data of the temperature detected by the temperature detection unit 61"), and also using the pieces of temperature data of the temperatures detected by the temperature detection units 62Y, 62M, 62C, and 62K near the photosensitive drums 2Y, 2M, 2C, and 2K, respectively, or the average value of the pieces of temperature data (hereinafter collectively referred to as the "temperature data of the temperature detected by the temperature detection unit 62").

In the image forming apparatus according to the present exemplary embodiment, any one of the pieces of temperature data or the average value of the pieces of temperature data is used on the assumption that the change in temperature of the laser scanner unit 1 and the change in temperature near the photosensitive drum 2 are almost the same in each station.

Figure 14:
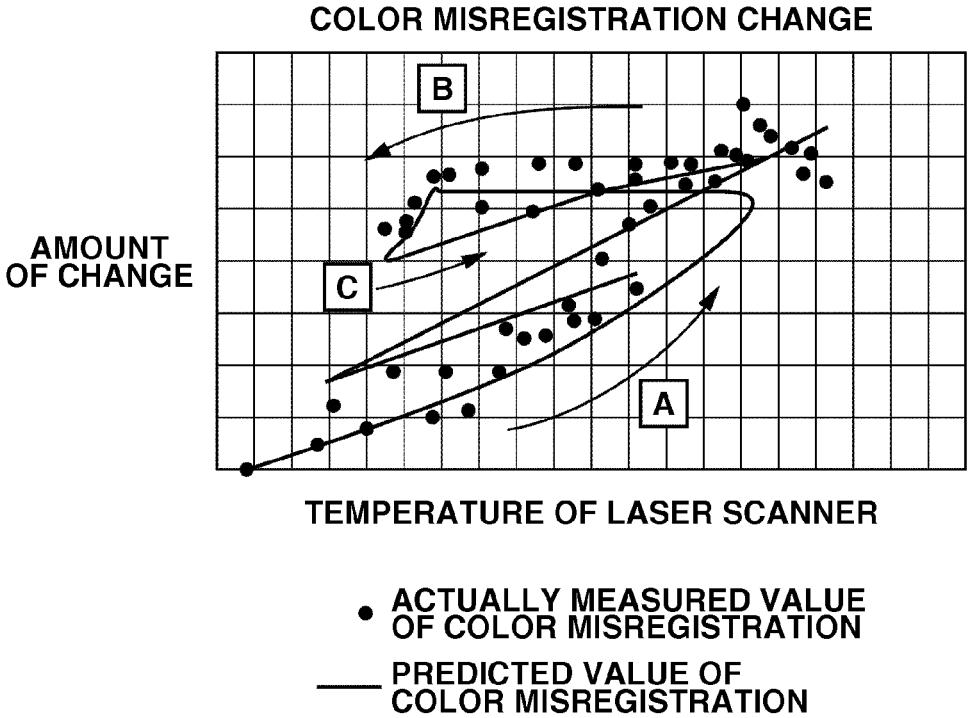
FIG. 14 is a diagram illustrating an amount of color misregistration based on prediction.

FIG. 14 illustrates a change in the amount of color misregistration corresponding to FIG. 11 and a predicted value of a change in the amount of color misregistration calculated, from the temperature of the laser scanner unit 1 and the temperature near the photosensitive drum 2 that have been described above, using the following formula (1).

$$\Delta X=\alpha\times\Delta Tls+\beta\cdot\Delta Tdrm \quad (1)$$

In the formula (1), ΔX is a predicted value of the change in the amount of color misregistration; ΔTls is the amount of change in temperature of the laser scanner unit 1; ΔTdrm is the amount of change in temperature near the photosensitive drum 2; and α and β are predetermined coefficients for calculating the predicted value ΔX.

The values of the coefficients α and β are calculated, using a multiple regression analysis by the method of least squares, from the actual amount of color misregistration of an image output from the image forming apparatus and the temperature data of the temperature of the laser scanner unit 1 or the temperature data of the temperature near the photosensitive drum 2 when the image has been output.

The predicted value of the change in the amount of color misregistration illustrated in FIG. 14 is more accurate than a predicted value of the change in the amount of color misregistration obtained only from the temperature data of the laser scanner unit 1 illustrated in FIG. 13.

According to the prediction-based color registration adjustment value calculation process according to the present exemplary embodiment, a color registration adjustment value is predicted based on the temperatures detected by a plurality of temperature detection units. Thus, it is possible to predict with high accuracy the amount of color misregistration according to a complex temperature change inside the image forming apparatus, which occurs in the various uses of the image forming apparatus.

Figure 15:
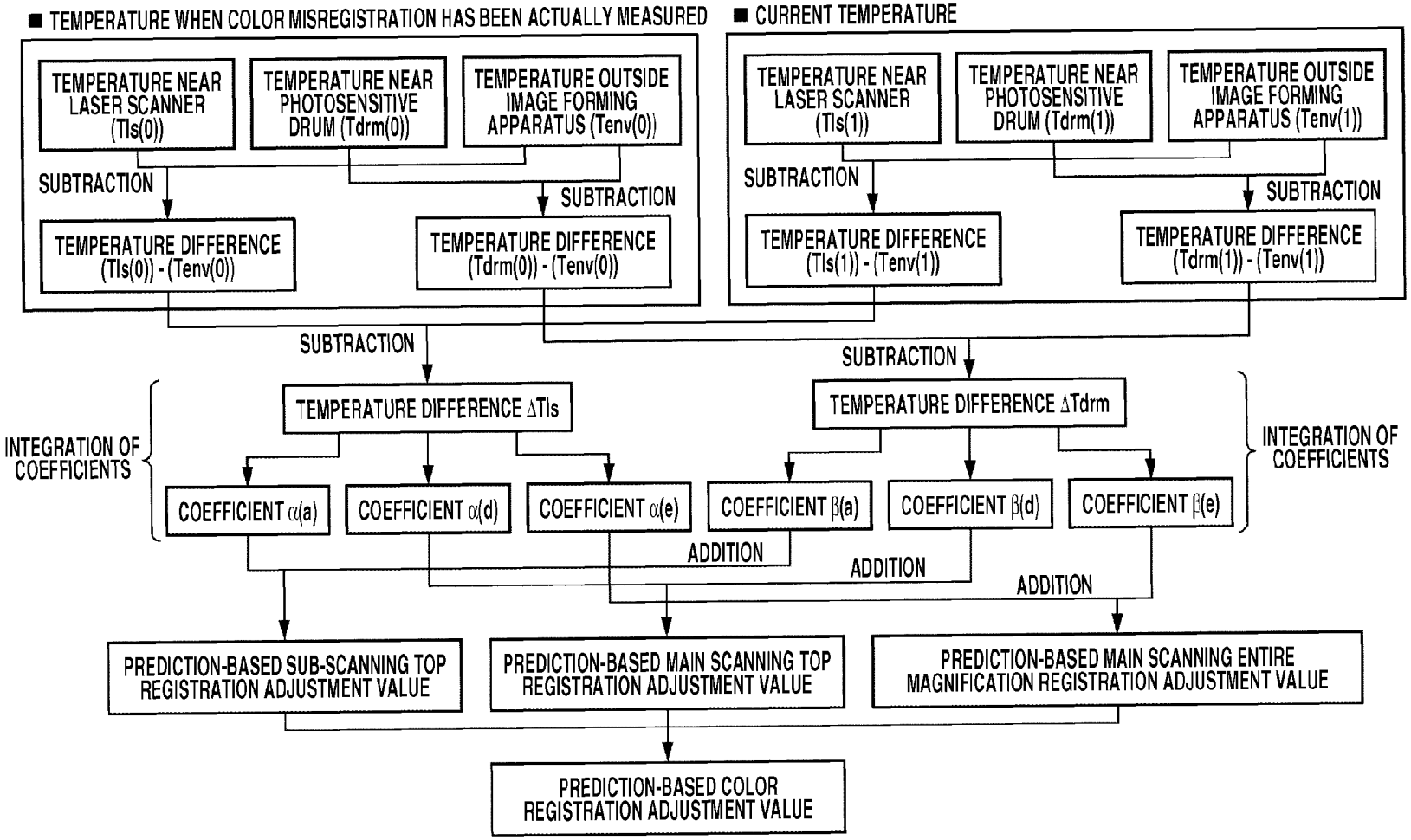
FIG. 15 is a diagram illustrating a prediction-based color registration adjustment value calculation process.

Referring to FIG. 15, the prediction-based color registration adjustment value calculation process performed by the prediction-based color registration adjustment value calculation unit 94 is described. A prediction-based color registration adjustment value is an adjustment value based on the temperature differences from the temperatures detected in the actual-measurement-based color registration adjustment value calculation process (step S101), and based also on the amount of color misregistration calculated in the actual-measurement-based color registration adjustment value calculation process. The prediction-based color registration adjustment value calculation process does not use the detection results of the detection sensors 46, 47, and 48, but uses the pieces of temperature data of the temperatures detected by the first, second, and third temperature detection units 61, 62, and 63.

First, the prediction-based color registration adjustment value calculation unit 94 obtains the pieces of temperature data of the current temperatures detected by the first, second, and third temperature detection units 61, 62, and 63. The prediction-based color registration adjustment value calculation unit 94 obtains temperature data Tls(1) of the current temperature near the laser scanner 1 from the first temperature detection unit 61, obtains temperature data Tdrm(1) of the current temperature near the photosensitive drum 2 from the second temperature detection unit 62, and obtains temperature data Tenv(1) of the current temperature outside the image forming apparatus from the third temperature detection unit 63.

Next, the prediction-based color registration adjustment value calculation unit 94 reads the temperature data Tls(0) of the temperature of the laser scanner unit 1, the temperature data Tdrm(0) of the temperature near the photosensitive drum 2, and the temperature data Tenv(0) of the temperature outside the image forming apparatus, which have been stored in the actual-measurement-based color registration adjustment value calculation process.

The prediction-based color registration adjustment value calculation unit 94 calculates the prediction-based color registration adjustment value ΔX from these pieces of temperature data, using the following formulas.

$$\Delta X=\alpha\times\Delta Tls+\beta\times\Delta Tdrm \quad (1)$$

$$\Delta Tls=(Tls(1)-Tenv(1))-(Tls(0)-Tenv(0)) \quad (2)$$

$$\Delta Tdrm=(Tdrm(1)-Tenv(1))-(Tdrm(0)-Tenv(0)) \quad (3)$$

The formula (1) is the same as the formula (1) described above. The formula (2) and the formula (3) are formulas representing detailed methods of calculating ΔTls and ΔTdrm.

The formula (2) includes terms calculating the difference between the temperature of the laser scanner unit 1 and the temperature outside the image forming apparatus, and the formula (3) includes terms calculating the difference between the temperature near the photosensitive drum 2 and the temperature outside the image forming apparatus. These terms remove the influence of a change in temperature outside the image forming apparatus. For example, if the outside air temperature has risen under the influence of a change in the outside air environment due to an air conditioner, the temperature of the laser scanner unit 1 and the temperature near the photosensitive drum 2 increase corresponding to the rise in the outside air temperature. Color misregistration is basically a phenomenon resulting from the temperature distribution inside the image forming apparatus. Thus, the temperature outside the image forming apparatus is subtracted so that the changes in temperature of the laser scanner unit 1 and the temperature near the photosensitive drum 2 due to the change in temperature outside the image forming apparatus do not influence the calculation of ΔX. However, although accuracy may become lower, it is also possible to predict a color registration adjustment value without using the temperature outside the image forming apparatus for the calculation of ΔX.

The value ΔX calculated by using the formula (1) is stored as the prediction-based color registration adjustment value. The color registration adjustment unit 91 performs a color registration adjustment using a color registration adjustment value obtained by adding the actual-measurement-based color registration adjustment value to the prediction-based color registration adjustment value.

The use of the prediction-based color registration adjustment value calculation process can achieve a high-accuracy color registration adjustment without frequently forming color registration patterns.

It is possible to predict ΔX with higher accuracy, using the coefficients α and β corresponding to each of the types of color misregistration described with reference to FIG. 8 ((a) sub-scanning top misregistration (sub-scanning entirety misregistration), (b) sub-scanning inclination misregistration, (c) sub-scanning curve misregistration, (d) main scanning top misregistration (main scanning entirety misregistration), (e) main scanning entire magnification misregistration, and (f) main scanning one-side magnification misregistration).

FIGS. 20A to 20F illustrate the change in the amount of color misregistration relative to the change in temperature of the laser scanner unit 1 in (a) sub-scanning top misregistration, (b) sub-scanning inclination misregistration, (c) sub-scanning curve misregistration, (d) main scanning top misregistration, (e) main scanning entire magnification misregistration, and (f) main scanning one-side magnification misregistration.

It is understood from FIGS. 20A to 20F that (a) sub-scanning top misregistration, (d) main scanning top misregistration, and (e) main scanning entire magnification misregistration have a high sensitivity to a temperature change. Therefore, in the present exemplary embodiment, not all the components (a) to (f) are predicted and adjusted, but (a) sub-scanning top misregistration, (d) main scanning top misregistration, and (e) main scanning entire magnification misregistration, which have a high sensitivity to a temperature change, are predicted.

In this case, the following formulas (4), (5), and (6) are used instead of the formula (1), depending on the type of color misregistration.

$$\Delta X(a)=\alpha(a)\times\Delta Tls+\beta(b)\times\Delta Tdrm \quad (4)$$

$$\Delta X(d)=\alpha(d)\times\Delta Tls+\beta(d)\times\Delta Tdrm \quad (5)$$

$$\Delta X(e)=\alpha(e)\times\Delta Tls+\beta(e)\times\Delta Tdrm \quad (6)$$

The three types of color misregistration, i.e., (a) sub-scanning top misregistration, (d) main scanning top misregistration, and (e) main scanning entire magnification misregistration, are likely to change under the influence of changes in the orientations of a lens and a mirror due to the deformation of the housing of the laser scanner due to a rise in temperature, or the expansion of a lens itself, or the expansion of the photosensitive drum 2. In other words, these types of color misregistration have a high sensitivity to a temperature change.

The other types of color misregistration, i.e., (b) sub-scanning inclination misregistration, (c) sub-scanning curve misregistration, and (f) main scanning one-side magnification misregistration, are greatly influenced by the initial orientations of a lens and a mirror, the relative tilt between the laser scanner and the photosensitive drum 2 due to the twist and the tilt of the frame member of the main body of the image forming apparatus. That is, these types of color misregistration have a low sensitivity to a temperature change.

The prediction of the components having a low sensitivity to a temperature change may even increase color misregistration by an excessive adjustment. Thus, in the present exemplary embodiment, the types of color misregistration having a high sensitivity to a temperature change are subjected to both the actual-measurement-based color registration adjustment value calculation process and the prediction-based color registration adjustment value calculation process. On the other hand, the types of color misregistration having a low sensitivity to a temperature change are not subjected to the prediction-based color registration adjustment value calculation process, but are subjected only to the actual-measurement-based color registration adjustment value calculation process.

Figure 17:
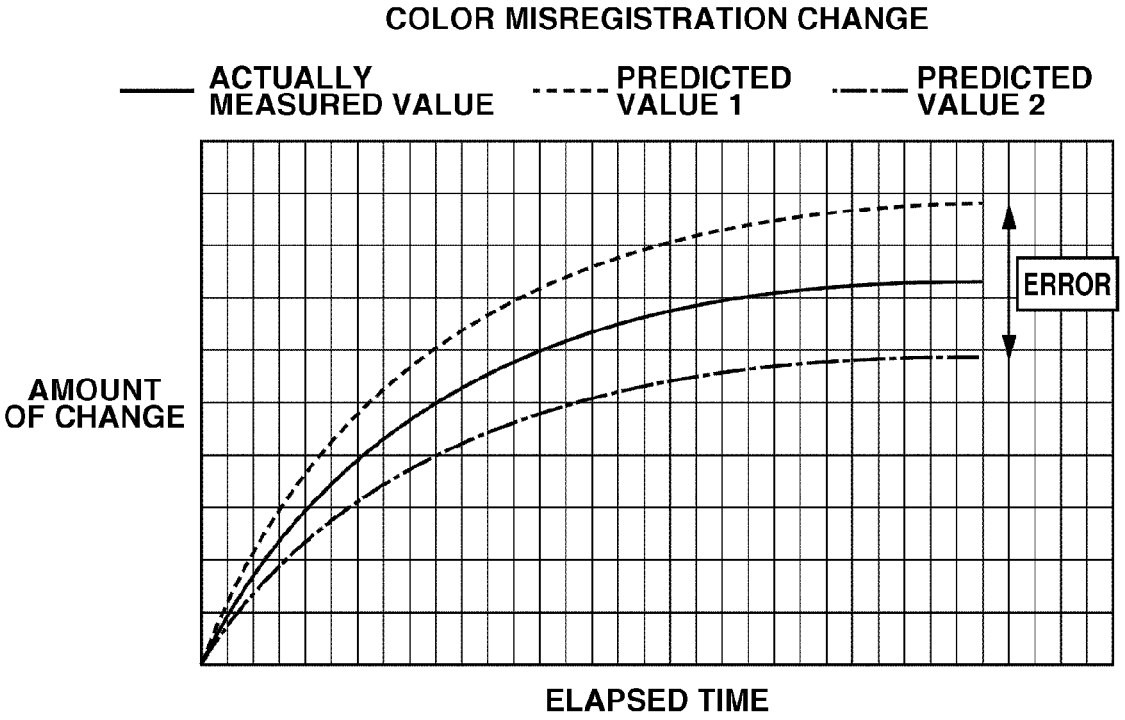
FIG. 17 is a conceptual diagram illustrating an amount of color misregistration based on prediction and errors.

Further, an increase in the amount of adjustment based on a prediction-based color registration adjustment value may increase the error between the actual color misregistration and the prediction-based color registration adjustment value. FIG. 17 illustrates the state where the errors between an actually measured value and predicted values of the amount of color misregistration increase with increases in the magnitude of the amount of change in color misregistration. A mechanical difference and an environmental difference cause variations in predicted values as illustrated by predicted values 1 and 2 in FIG. 17. It is understood that as the amount of adjustment based on the predicted value becomes greater, the error becomes greater.

Therefore, in the present exemplary embodiment, the temperature range in which the prediction-based color registration adjustment value calculation process is performed is limited by the following condition.

$$\Delta T\text{limit} \leq \Delta Tls(1) - \Delta Tenv(1) \quad (7)$$

The formula (7) represents the difference between the current temperature near the laser scanner and the temperature outside the image forming apparatus. An increase in the difference increases ΔX as well. Thus, if the difference is equal to or greater than a predetermined value (ΔTlimit), the prediction-based color registration adjustment value calculation process is not to be performed. In the formula (7), ΔTls may be replaced by ΔTdrm. Alternatively, both ΔTls and ΔTdrm may be used.

As described above, the limitation on the temperature range in which the prediction-based color registration adjustment value calculation process is performed can prevent an increase in the error. In other words, the prediction-based color registration adjustment value calculation process can prevent an increase in color misregistration.

Figure 16:
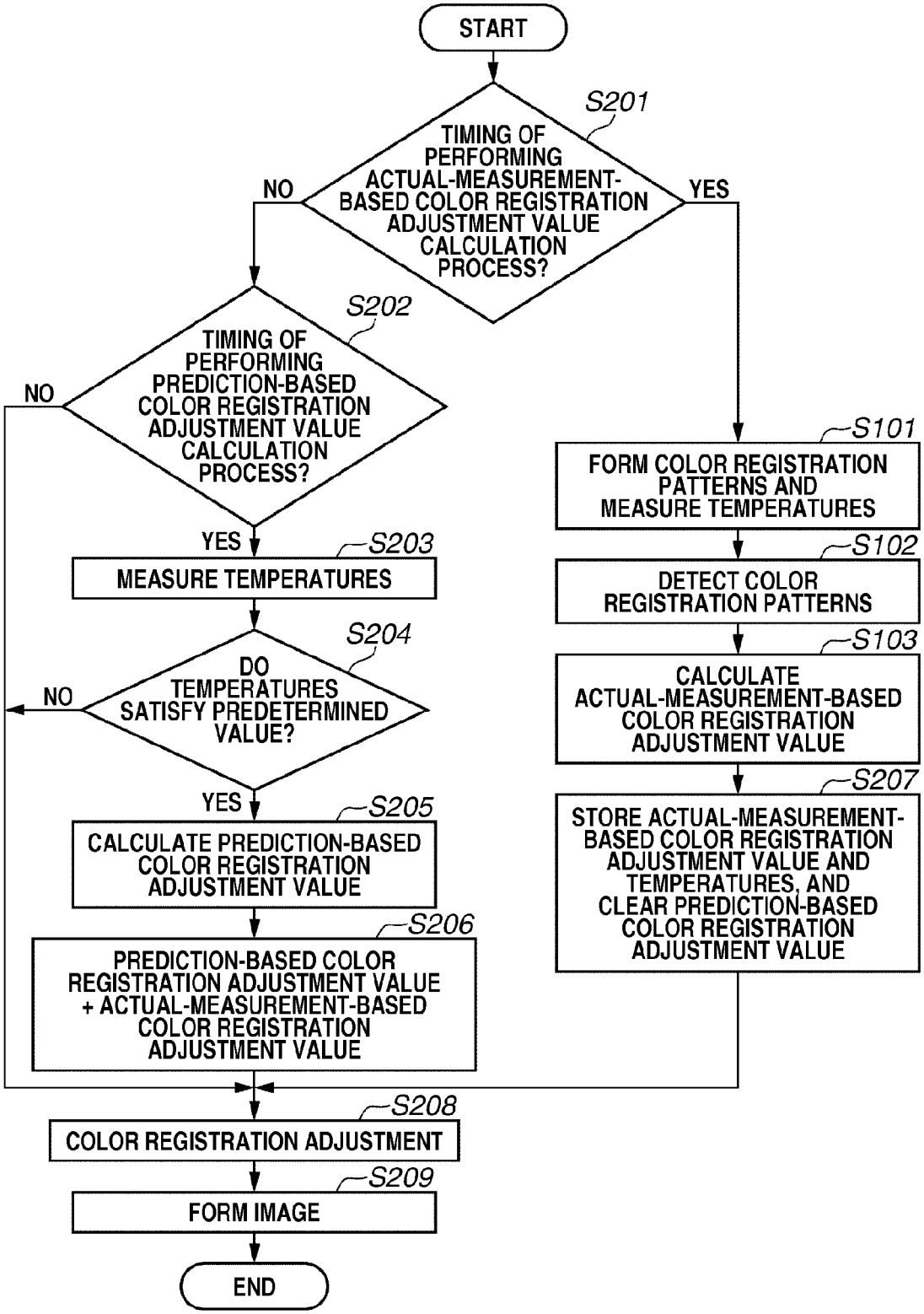
FIG. 16 is a flow chart regarding color registration adjustment control.

FIG. 16 illustrates a flow chart regarding color registration adjustment control performed by the CPU 90.

First, in step S201, the CPU 90 determines whether it is now the timing of performing the actual-measurement-based color registration adjustment value calculation process. In the present exemplary embodiment, if a predetermined condition has been satisfied when the image forming apparatus has been turned on or between print jobs, the CPU 90 determines that the it is the timing of performing the actual-measurement-based color registration adjustment value calculation process. The predetermined condition is, for example, a case where the number of printed sheets has reached a predetermined number, or a predetermined time has elapsed, since the actual-measurement-based color registration adjustment value calculation process has been performed.

If the CPU 90 has determined in step S201 that it is the timing of performing the actual-measurement-based color registration adjustment value calculation process (YES in step S201), the CPU 90 causes the actual-measurement-based color registration adjustment value calculation unit 93 to perform the actual-measurement-based color registration adjustment value calculation process described with reference to FIG. 10 (refer to steps S101 to S103). Then, in step S207, the CPU 90 stores the calculated actual-measurement-based color registration adjustment value and the pieces of temperature data. The pieces of temperature data to be stored are the temperature data (Tls(0)) of the temperature of the laser scanner unit 1 detected by the first temperature detection unit 61, the temperature data (Tdrm(0)) of the temperature near the photosensitive drum 2 detected by the second temperature detection unit 62, and the temperature data (Tenv(0)) of the temperature outside the image forming apparatus detected by the third temperature detection unit 63. Further, the CPU 90 clears the stored value resulting from adding the prediction-based color registration adjustment value ΔX to the actual-measurement-based color registration adjustment value. Regardless of the predetermined condition described above, also when an instruction has been given by a user, the CPU 90 causes the actual-measurement-based color registration adjustment value calculation unit 93 to perform the actual-measurement-based color registration adjustment value calculation process.

On the other hand, if the CPU 90 has determined in step S201 that it is not the timing of performing the actual-measurement-based color registration adjustment value calculation process (NO in step S201), then in step S202, the CPU 90 determines whether it is the timing of performing the prediction-based color registration adjustment value calculation process.

The timing of performing the prediction-based color registration adjustment value calculation process is, for example, a case where the number of printed sheets has reached a predetermined number, or a predetermined time has elapsed since the time of the execution of the actual-measurement-based color registration adjustment value calculation process or the time of the execution of the previous prediction-based color registration adjustment value calculation process. This condition, however, is set more strictly than the condition used in step S201, and is set so that the prediction-based color registration adjustment value calculation process is performed at a timing having intervals shorter than the intervals used in the actual-measurement-based color registration adjustment value calculation process.

If the CPU 90 has determined in step S202 that it is the timing of performing the prediction-based color registration adjustment value calculation process (YES in step S202), then in step S203, the CPU 90 obtains temperature detection results from the first, second, and third temperature detection units 61, 62, and 63. The CPU 90 obtains the temperature data (Tls(1)) of the temperature of the laser scanner unit 1 from the first temperature detection unit 61, obtains the temperature data (Tdrm(1)) of the temperature near the photosensitive drum 2 from the second temperature detection unit 62, and obtains the temperature data (Tenv(1)) of the temperature outside the image forming apparatus from the third temperature detection unit 63.

In step S204, the CPU 90 determines, using the temperature data Tls(1) and the temperature data Tenv(1) obtained in step S203, whether the condition of the formula (7) is satisfied.

$$\Delta T\text{limit} \leq \Delta Tls(1) - \Delta Tenv(1) \quad (7)$$

If the CPU 90 has determined in step S204 that the condition is satisfied (YES in step S204), then in step S205, the CPU 90 causes the prediction-based color registration adjustment value calculation unit 94 to perform the prediction-based color registration adjustment value calculation process described with reference to FIG. 15.

A prediction-based color registration adjustment value is an adjustment value corresponding to the temperature differences from the temperatures detected in the actual-measurement-based color registration adjustment value calculation process (step S101). Thus, in step S206, to calculate an adjustment value to be used by the color registration adjustment unit 91, the prediction-based color registration adjustment value calculation unit 94 adds the prediction-based color registration adjustment value calculated in step S205 to the actual-measurement-based color registration adjustment value stored in step S207. Then, the prediction-based color registration adjustment value calculation unit 94 updates the stored value resulting from addition, using the value calculated by the addition in step S206.

In step S208, the CPU 90 causes the color registration adjustment unit 91 to perform a color registration adjustment. In step S209, the CPU 90 causes the image forming apparatus to form an image. If the actual-measurement-based color registration adjustment value calculation process has been performed, the CPU 90 causes the color registration adjustment unit 91 to perform the color registration adjustment using the actual-measurement-based color registration adjustment value calculated in step S207. If the prediction-based color registration adjustment value calculation process has been performed, the CPU 90 causes the color registration adjustment unit 91 to perform the color registration adjustment using the value calculated by the addition in step S206. If neither the actual-measurement-based color registration adjustment value calculation process nor the prediction-based color registration adjustment value calculation process have been performed (NO in step S202 and NO in step S204), the CPU 90 causes the color registration adjustment unit 91 to perform the color registration adjustment using the stored value resulting from addition. If the stored value resulting from addition has been cleared (i.e., if the prediction-based color registration adjustment value calculation process has not been performed after the actual-measurement-based color registration adjustment value calculation process), the CPU 90 causes the color registration adjustment unit 91 to perform the color registration adjustment using the actual-measurement-based color registration adjustment value stored in step S207.

In step S202, if any one of the detection results of the temperature detection units 61, 62, and 63 has changed by a predetermined value or more, the CPU 90 may determine that it is the timing of performing the prediction-based color registration adjustment value calculation process. If ΔTls(1)−ΔTenv is used, which is calculated from the detection results of the temperature detection units 61 and 63, the predetermined value is set to a value smaller than ΔTlimit.

Figure 18:
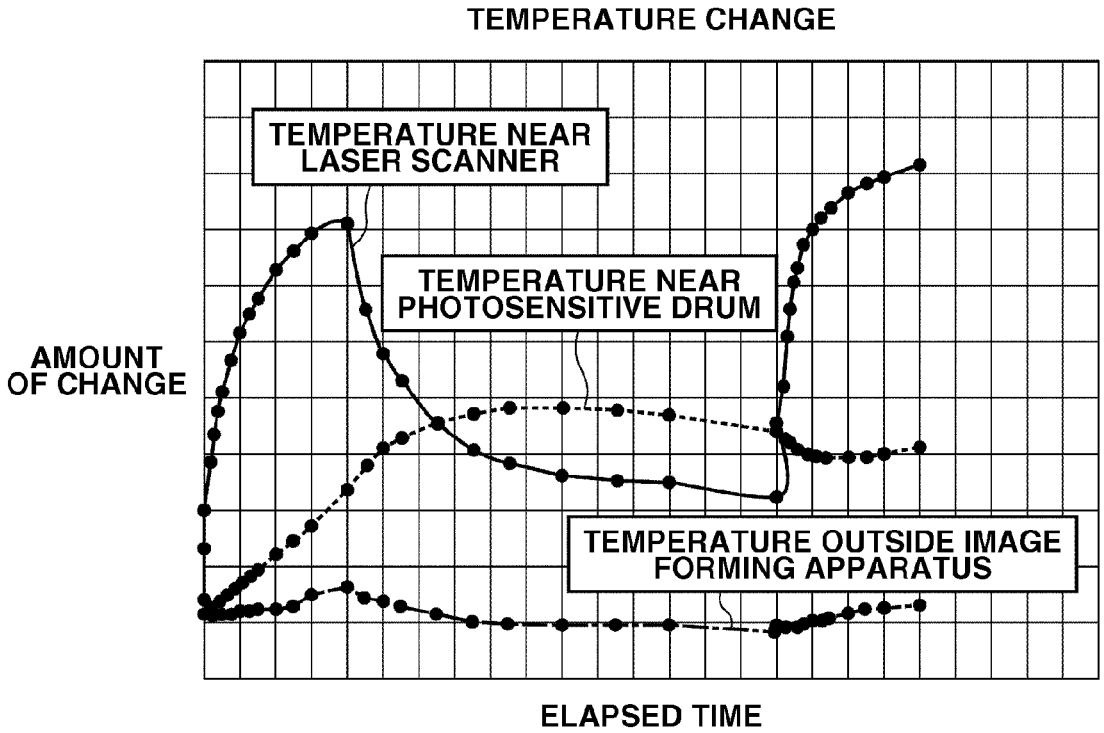
FIG. 18 is a diagram illustrating changes in temperature inside the image forming apparatus in an off-state of a heater.
Figure 19:
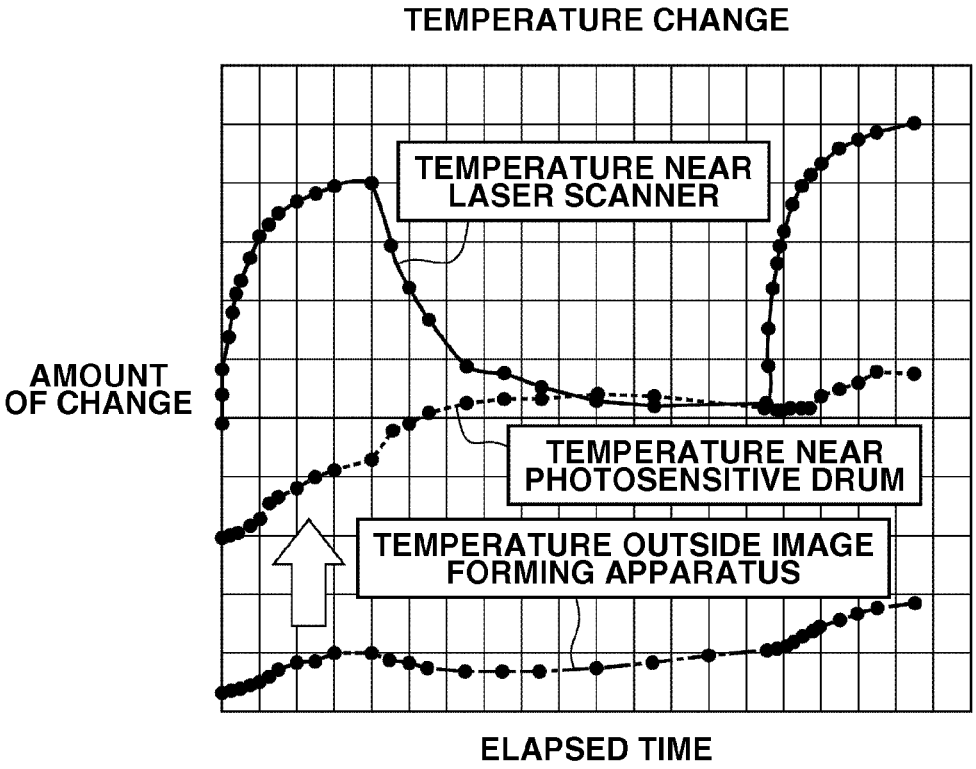
FIG. 19 is a diagram illustrating changes in temperature inside the image forming apparatus in an on-state of the heater.
Figure 20A:
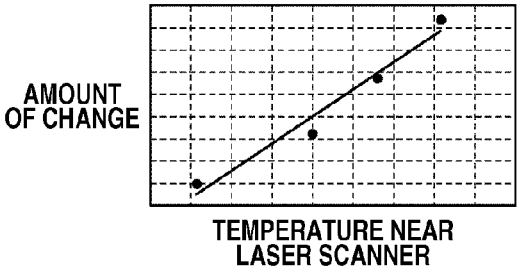
FIGS. 20A to 20F are diagrams illustrating a change in an amount of color misregistration in a plurality of types of color misregistration.
Figure 20B:
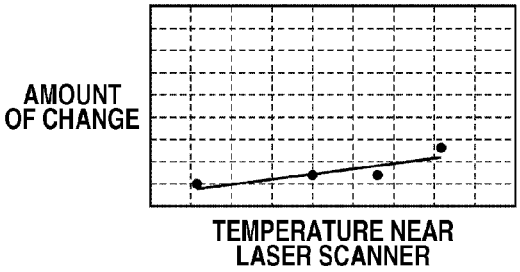
Figure 20C:
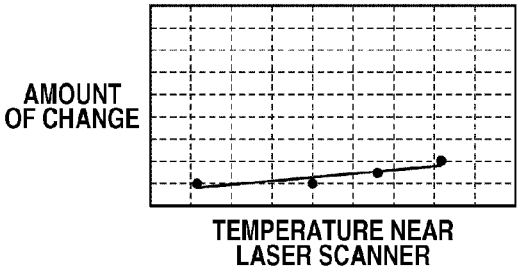
Figure 20D:
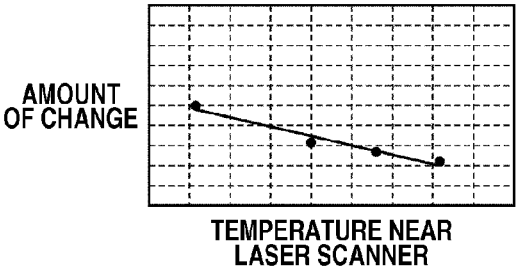
Figure 20E:
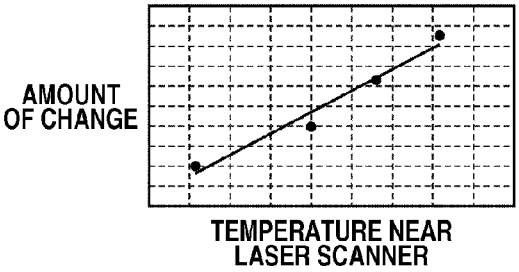
Figure 20F:
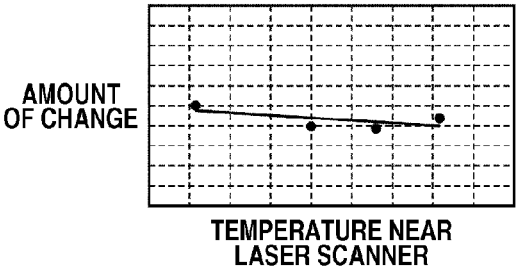

There is also an image forming apparatus having a heater (not illustrated) near each of the photosensitive drums 2Y, 2M, 2C, and 2K to stabilize the image quality by preventing image deletion in a high-humidity environment. In the image forming apparatus having the heater, also the temperature near the laser scanner and the temperature near the image bearing member rise with the on-state of the heater. This causes an offset in temperature of a sensor outside the image forming apparatus. In this case, it is not possible to appropriately make the determination in step S204 using the formula (7). FIG. 18 illustrates examples of pieces of temperature data in the off-state of the heater. FIG. 19 illustrates examples of pieces of temperature data in the on-state of the heater.

In step S204, the following formula (8) may be used if the heater is on.

$$\Delta T\text{limit2} \leq \Delta Tls(1) - \Delta Tdrm(1) \quad (8)$$

In the formula (8), ΔTlimit2 is a value not directly related to the calculation of a predicted value, but the formula (8) can substitute for the formula (7). If the heater is provided near each of the photosensitive drums 2Y, 2M, 2C, and 2K, the temperature near the photosensitive drum 2 becomes more stable and has a gentler slope in the on-state of the heater than in the off-state of the heater. Thus, the rising change in temperature of the laser scanner unit 1 becomes dominant in the color misregistration. Thus, by comparing the rising change in temperature of the laser scanner unit 1 to the difference in temperature near the photosensitive drum 2, which has a gentler slope, it is possible to obtain a condition approximately equivalent to the condition for the determination using the formula (7) in the off-state of the heater.

Further, according to the present exemplary embodiment, when the image forming apparatus has been turned on, the actual-measurement-based color registration adjustment value calculation process is performed. If the actual-measurement-based color registration adjustment value calculation process has been unsuccessful due to some cause, the subsequent prediction-based color registration adjustment value calculation process is not performed.

In the present exemplary embodiment, the Y, M, C, and K stations are subjected to similar processes. In the image forming apparatus illustrated in FIG. 1, however, the configuration of the K station is different from the configurations of the Y, M, and C stations. In the K station, color misregistration appears notably when the temperature inside the image forming apparatus has changed.

Figure 21A:
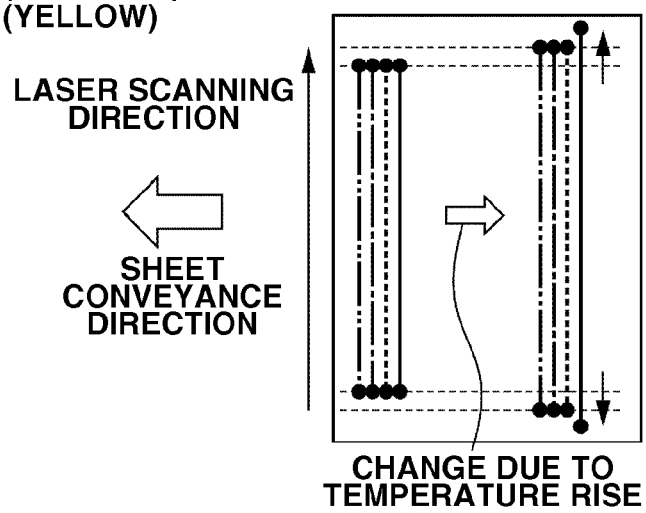
FIGS. 21A to 21C are schematic diagrams illustrating a change in the amount of color misregistration due to differences in configuration.
Figure 21B:
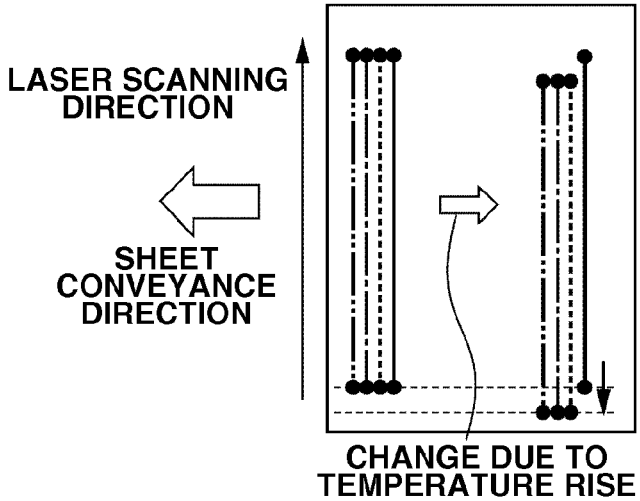
Figure 21C:
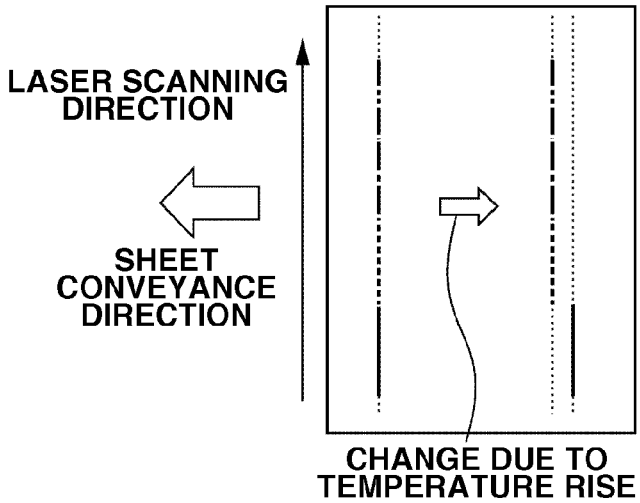

FIGS. 21A to 21C illustrate an outline of color misregistration. FIG. 21A illustrates (e) main scanning entire magnification misregistration, FIG. 21B illustrates (d) main scanning top misregistration, and FIG. 21C illustrates (a) sub-scanning top misregistration.

The scanning lines illustrated in FIGS. 21A to 21C are the results of performing the color registration adjustment control described in the first exemplary embodiment. Due to the fact that the configuration of the K station is thus different from the configurations of the Y, M, and C stations, only the K station leads to misregistration.

Thus, as predicted values Δ(a), Δ(d), and Δ(e) of the change in color misregistration due to the differences in configuration between the K station, and the Y, M, and C stations, only the amount of change in color misregistration of the K station relative to the station Y, M, or C may be calculated. Alternatively, as the amounts of change in color misregistration of the Y, M, and C stations relative to the K station, the same adjustment value may be calculated for the Y, M, and C stations.

Further, in the above exemplary embodiment, the first temperature detection unit 61 detects the temperature inside the housing of the laser scanner unit 1, but may detect the temperature near the laser scanner unit 1. Further, the first temperature detection unit 61 is provided for each of the Y, M, C, and K stations, but may be provided for any one of the Y, M, C, and K stations. Alternatively, two first temperature detection units 61 may be provided, one for any one of the Y, M, and C stations and the other for the K station.

Further, in the above exemplary embodiment, the second temperature detection unit 62 detects the temperature near the photosensitive drum 2, but may detect the temperature of the surface of the photosensitive drum 2. Further, the second temperature detection unit 62 is provided for each of the Y, M, C, and K stations, but may be provided for any one of the Y, M, C, and K stations. Alternatively, two second temperature detection units 62 may be provided, one for any one of the Y, M, and C stations and the other for the K station.

Figure 22:
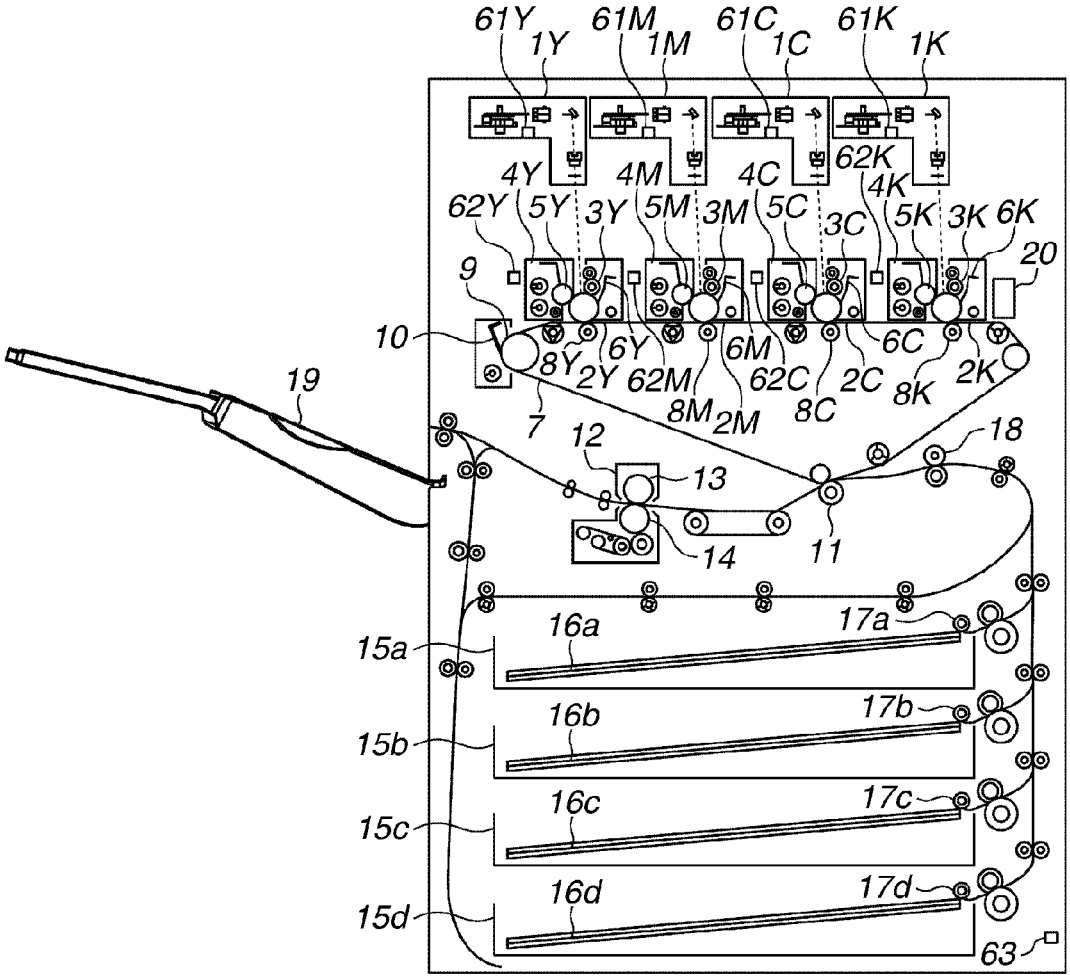
FIG. 22 is a cross-sectional view of an image forming apparatus according to another exemplary embodiment.

Further, instead of the image forming apparatus illustrated in FIG. 1, a tandem image forming apparatus illustrated in FIG. 22 may be used in which the Y, M, C, and K stations include image forming units having similar configurations. Alternatively, an image forming apparatus may be employed that uses a 2-in-1 scanner or a 4-in-1 scanner, which scans a plurality of photosensitive drums with one polygon mirror.

Further, in the above exemplary embodiment, an on-demand fixing unit that can start quickly is used as a fixing device. Alternatively, another fixing device may be used. The image forming apparatus using another fixing device also produces a temperature change. Thus, the use of the color registration adjustment control according to the above exemplary embodiment can achieve a higher-accuracy color registration adjustment.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-196239 filed Sep. 6, 2012, which is hereby incorporated by reference herein in its entirety.

What is claimed is:

1. A color image forming apparatus comprising:

an image forming unit, including a plurality of photosensitive members and an exposure device to expose each of the plurality of photosensitive members to form electrostatic latent images, configured to form images corresponding to a plurality of colors by developing the electrostatic latent images formed on the plurality of photosensitive members by the exposure device;

a transfer member onto which the plurality of images formed by the image forming unit are transferred;

a first temperature detection unit configured to detect a first temperature of the exposure device;

a second temperature detection unit disposed at a position different from the first temperature detection unit, configured to detect a second temperature of the image forming units;

a third temperature detection unit configured to detect a third temperature corresponding to a temperature outside the image forming apparatus;

a color registration pattern detection unit configured to detect a color registration pattern formed on the transfer member;

a determination unit configured to determine a color registration adjustment value; and a color registration adjustment unit configured to perform a color registration adjustment based on the color registration adjustment value, wherein the determination unit includes:

a first determination unit configured to determine a first color registration adjustment value from a detection result of the color registration pattern detection unit; and a second determination unit configured to determine a second color registration adjustment value from the first temperature detected by the first temperature detection unit, the second temperature detected by the second temperature detection unit, and the third temperature detected by the third temperature detection unit, wherein the second determination unit determines the second color registration adjustment value based on a difference between the first temperature and the third temperature, and a difference between the second temperature and the third temperature.

2. The color image forming apparatus according to claim 1, wherein the second determination unit determines the second color registration adjustment value based on:

the first temperature detected by the first temperature detection unit, the second temperature detected by the second temperature detection unit, and the third temperature detected by the third temperature detection unit, the temperatures being obtained when the first determination unit determines the first color registration adjustment value; and the first temperature detected by the first temperature detection unit, the second temperature detected by the second temperature detection unit, and the third temperature detected by the third temperature detection unit, the temperatures being obtained when the second determination unit determines the second color registration adjustment value.

3. The color image forming apparatus according to claim 1, wherein, if the first temperature detected by the first temperature detection unit does not satisfy a predetermined condition, the second determination unit does not calculate the second color registration adjustment value.

4. The color image forming apparatus according to claim 1, wherein, if the second temperature detected by the second temperature detection unit does not satisfy a predetermined condition, the second determination unit does not calculate the second color registration adjustment value.

5. The color image forming apparatus according to claim 1, wherein the first determination unit determines first color registration adjustment values for first and second types of color misregistration, and wherein the second determination unit determines a second color registration adjustment value for the first type of color misregistration without determining a second color registration adjustment value for the second type of color misregistration.

6. The color image forming apparatus according to claim 5, wherein the first type of color misregistration is sub-scanning entire misregistration, and the second type of color misregistration is sub-scanning inclination misregistration.

7. The color image forming apparatus according to claim 1, wherein the first temperature detection unit detects a temperature inside a housing of the exposure device or a temperature near the exposure device.

8. The color image forming apparatus according to claim 1, wherein the second temperature detection unit detects a temperature of a surface of the photosensitive member or a temperature near the photosensitive member.

9. A color image forming apparatus comprising:

an image forming unit, including a plurality of photosensitive members and an exposure device to expose each of the plurality of photosensitive members to form electrostatic latent images, configured to form images corresponding to a plurality of colors by developing the electrostatic latent images formed on the plurality of photosensitive members by the exposure device;

a transfer member onto which the plurality of images formed by the image forming unit are transferred;

a first temperature detection unit configured to detect a first temperature of the exposure device;

a second temperature detection unit configured to detect a second temperature;

a third temperature detection unit configured to detect a third temperature, wherein a distance between the first temperature detection unit and the third temperature detection unit, is farther than a distance between the first temperature detection unit and the second temperature detection unit, a color registration pattern detection unit configured to detect a color registration pattern formed on the transfer member;

a determination unit configured to determine a color registration adjustment value; and a color registration adjustment unit configured to perform a color registration adjustment based on the color registration adjustment value, wherein the determination unit includes:

a first determination unit configured to determine a first color registration adjustment value from a detection result of the color registration pattern detection unit; and a second determination unit configured to determine a second color registration adjustment value from the first temperature detected by the first temperature detection unit, the second temperature detected by the second temperature detection unit, and the third temperature detected by the third temperature detection unit, wherein the second determination unit determines the second color registration adjustment value based on a difference between the first temperature and the third temperature, and a difference between the second temperature and the third temperature.

10. The color image forming apparatus according to claim 9, further comprising:

a storing unit configured to store a recording medium to which an image on the transfer member is transferred, wherein the third temperature detection unit is disposed near the storing unit.

11. The color image forming apparatus according to claim 9, wherein the second determination unit determines the second color registration adjustment value based on:

the first temperature detected by the first temperature detection unit, the second temperature detected by the second temperature detection unit, and the third temperature detected by the third temperature detection unit, the temperatures being obtained when the first determination unit determines the first color registration adjustment value; and the first temperature detected by the first temperature detection unit, the second temperature detected by the second temperature detection unit, and the third temperature detected by the third temperature detection unit, the temperatures being obtained when the second determination unit determines the second color registration adjustment value.

12. The color image forming apparatus according to claim 9, wherein, if the first temperature detected by the first temperature detection unit does not satisfy a predetermined condition, the second determination unit does not calculate the second color registration adjustment value.

13. The color image forming apparatus according to claim 9, wherein, if the second temperature detected by the second temperature detection unit does not satisfy a predetermined condition, the second determination unit does not calculate the second color registration adjustment value.

14. The color image forming apparatus according to claim 9, wherein the first determination unit determines first color registration adjustment values for first and second types of color misregistration, and wherein the second determination unit determines a second color registration adjustment value for the first type of color misregistration without determining a second color registration adjustment value for the second type of color misregistration.

15. The color image forming apparatus according to claim 14, wherein the first type of color misregistration is sub-scanning entire misregistration, and the second type of color misregistration is sub-scanning inclination misregistration.

16. The color image forming apparatus according to claim 9, wherein the first temperature detection unit detects a temperature inside a housing of the exposure device or a temperature near the exposure device.

17. The color image forming apparatus according to claim 9, wherein the second temperature detection unit detects a temperature of a surface of the photosensitive member or a temperature near the photosensitive member.

* * * * *